US008274452B2

(12) United States Patent
Kim

(10) Patent No.: US 8,274,452 B2
(45) Date of Patent: Sep. 25, 2012

(54) ORGANIC LIGHT EMITTING DISPLAY HAVING COMPENSATION FOR TRANSISTOR THRESHOLD VARIATION

(75) Inventor: Yangwan Kim, Youngin-si (KR)

(73) Assignee: Samsung Mobile Display Co., Ltd, Gyeonggi-Do (KR)

( * ) Notice: Subject to any disclaimer, the term of this patent is extended or adjusted under 35 U.S.C. 154(b) by 1176 days.

(21) Appl. No.: 11/879,312

(22) Filed: Jul. 16, 2007

(65) Prior Publication Data

US 2008/0170008 A1 Jul. 17, 2008

(30) Foreign Application Priority Data

Jan. 16, 2007 (KR) ..... 10-2007-0004861

(51) Int. Cl.
*G09G 3/30* (2006.01)

(52) U.S. Cl. ..... 345/76; 313/484; 313/498; 315/169.1

(58) Field of Classification Search ..... 345/36, 345/45, 76–83; 313/484–487, 498–502; 315/169.1–169.4
See application file for complete search history.

(56) References Cited

U.S. PATENT DOCUMENTS

| | | | | |
|---|---|---|---|---|
| 6,873,117 | B2 | 3/2005 | Ishizuka | |
| 6,975,293 | B2 | 12/2005 | Yen et al. | |
| 7,009,591 | B2 | 3/2006 | Shibusawa | |
| 7,187,350 | B2 | 3/2007 | Yoshida | |
| 7,205,965 | B2 | 4/2007 | Mikami et al. | |
| 7,580,015 | B2 | 8/2009 | Tai et al. | |
| 2004/0004443 | A1 | 1/2004 | Park et al. | |
| 2004/0108979 | A1 | 6/2004 | Seki | |
| 2005/0224297 | A1* | 10/2005 | Felder et al. | 187/395 |
| 2005/0275352 | A1 | 12/2005 | Sun | |
| 2006/0055336 | A1* | 3/2006 | Jeong | 315/169.3 |
| 2006/0151745 | A1 | 7/2006 | Kim et al. | |
| 2006/0221662 | A1* | 10/2006 | Park et al. | 365/145 |
| 2006/0238461 | A1 | 10/2006 | Goh et al. | |
| 2007/0057873 | A1 | 3/2007 | Uchino et al. | |
| 2008/0001857 | A1 | 1/2008 | Yoo | |
| 2008/0111804 | A1 | 5/2008 | Choi et al. | |

FOREIGN PATENT DOCUMENTS

| | | | |
|---|---|---|---|
| EP | 1531450 | A2 | 5/2005 |
| EP | 1655719 | A2 | 5/2006 |
| EP | 1 923 857 | A2 | 5/2008 |
| JP | 2005-189696 | A | 7/2005 |

(Continued)

OTHER PUBLICATIONS

Office Action dated Oct. 14, 2010 in U.S. Appl. No. 12/005,699.

(Continued)

*Primary Examiner* — Kevin M Nguyen
*Assistant Examiner* — Cory Almeida
(74) *Attorney, Agent, or Firm* — Knobbe Martens Olson & Bear LLP

(57) ABSTRACT

An organic light emitting display including a demux is disclosed. The display include a plurality of RGB switching transistors which apply a data voltage through RGB data lines as the RGB switching transistors are coupled to the respective RGB data lines, and a plurality of RGB pixel circuits coupled to the RGB switching transistors of the demux. In addition, the RGB data voltage of the demux can be applied during a period which a turn-on emission control signal is applied to the RGB pixel circuits.

32 Claims, 13 Drawing Sheets

FOREIGN PATENT DOCUMENTS

| | | | |
|---|---|---|---|
| KR | 10-2006-0018766 | | 3/2006 |
| KR | 10-2006-0053754 | A | 5/2006 |
| KR | 10-2006-0064129 | A | 6/2006 |
| KR | 20-2006-0109343 | | 10/2006 |
| KR | 10-2007-002189 | A | 1/2007 |
| WO | WO 2004/066249 | | 8/2004 |
| WO | WO 2004/104975 | A1 | 12/2004 |

OTHER PUBLICATIONS

Office Action dated Mar. 30, 2011 for related U.S. Appl. No. 12/005,699, filed Dec. 27, 2007.

European Examination Report dated Apr. 18, 2011 for European Application No. EP 08 250 060.4 which shares priority of Korean Patent Application No. KR 10-2007-0004860 with U.S. Appl. No. 12/005,699, filed Dec. 27, 2007, which is related to the captioned application.

Office Action dated Jun. 20, 2001 for U.S. Appl. No. 12/005,699, filed Dec. 27, 2007, which is related to captioned U.S. Appl. No. 11/879,312.

Office Action dated Nov. 18, 2011 for related U.S. Appl. No. 12/005,699, filed Dec. 27, 2007.

* cited by examiner

ORGANIC LIGHT EMITTING DISPLAY HAVING COMPENSATION FOR TRANSISTOR THRESHOLD VARIATION

CROSS-REFERENCE TO RELATED APPLICATION

This application claims priority to and the benefit of Korean Patent Application No. 10-2007-0004861, filed on Jan. 16, 2007, the entire content of which is incorporated herein by reference.

BACKGROUND OF THE INVENTION

1. Field of the Invention

The field relates to an organic light emitting display, and more particularly, to a method for driving a demultiplexer (demux) wherein when an RGB data signal is applied by using the demux, the RGB data can be stored in each storage capacitor of pixel circuits by applying the RGB data signal during a period in which an emission control signal is on regardless of a scan signal being on or off.

In addition, the field relates to a pixel circuit of an organic light emitting display. The pixel circuit uses fewer transistors so that the pixel circuit can be highly integrated. Consequently, high resolution can be accomplished. Furthermore, the threshold voltage of a driving transistor can be compensated for, and IR-drop of a first power supply line can be improved.

In addition, the field relates to a method for driving a demultiplexer (demux) including white balance compensation.

2. Description of the Related Technology

Recently, organic light emitting displays have been used as a flat panel display because they are thin, have a wide viewing angle and have high speed responsiveness.

The organic light emitting display can control the brightness of each pixel and display an image by controlling the amount of electric current flowing through an organic light emitting diode(OLED).

That is to say, once a current corresponding to a data voltage is supplied to an organic light emitting diode, the organic light emitting diode emits light corresponding to the current supplied. Here, the data voltage applied to the organic light emitting diode has a value of various steps within a predetermined range in order to display a grey scale.

When a thin film transistor, which adopts amorphous silicon (a-si), is used, it has a weakness in that ability for driving a current can be relatively low. However, it also has merits in that the uniformity of the display device is excellent, and it is more suitable for being manufactured in a large-sized display.

In addition, in case that RGB data signals are applied to pixel circuits by using a demux, if the emission control signals applied through the emission control line (EM[N]) coupled to the pixel circuits are turned off, the RGB data signals can be stored in a storage capacitor of the pixel circuit improperly.

That is to say, in case that RGB data signals (voltages) are applied by driving a demux continuously on the condition that the RGB data signals (voltages) which are already stored in the storage capacitors are not yet initialized, it can cause a problem in that proper RGB data signals (voltages) cannot be stored in the storage capacitors.

The uniformity of the luminance of the display panel can have low quality because a driving transistor of the respective pixel circuits of an organic light emitting display can have different threshold voltages. In addition, the lower portion of the panel can have even worse luminance because IR-drop occurs as a first power supply line (VDD) passes through the respective pixel circuits.

In case that a pixel circuit of an organic light emitting display includes a large number of transistors, it can impede high resolution of the panel equipped with the pixel circuit because high integration becomes impossible.

In the case of conventional circuits for compensating the threshold voltage of a driving transistor in the pixel circuit, a path from a control electrode of the driving transistor to a negative power supply voltage is formed, and then a leakage current can flow through the path. Consequently, it can cause an improper emission of an organic light emitting diode.

In the case of a full color organic light emitting display, a full color display can be accomplished by equipping the display device with an organic light emitting diode which emits light of three colors of red, green and blue. However, the materials used as an organic light emission layer can be degraded by the heat generated during self emission. Because of the degradation, the luminance of the organic light emitting diode can deteriorate. As a result, the life span of the organic light emitting diode can be limited.

Because the degree of the degradation of an organic light emission layer which forms a red, green and blue organic light emission layer differs from one another, the difference of the luminance of the red, green and blue organic light emission layer can become larger as time goes by. Accordingly, the desired color cannot be reproduced because of the different rates of degradation of the red, green, and blue layers. That is to say, because each emission layer corresponding to red, green and blue has a different life span from one another, the white balance is difficult to maintain in case that the emission layer is driven for a long time.

SUMMARY OF CERTAIN INVENTIVE ASPECTS

One aspect is an organic light emitting display, including a demux which includes a plurality of switching transistors, the transistors coupled to data lines, the switching transistors configured to apply a data voltage to the data lines, and a plurality of pixel circuits coupled to the switching transistors of the demux, where the data voltage demux is applied during a period which a turn-on emission control signal is applied to the pixel circuits.

BRIEF DESCRIPTION OF THE DRAWINGS

The accompanying drawings are included to provide a further understanding. The drawings illustrate embodiments and, together with the description, serve to explain the principles of the embodiments.

DETAILED DESCRIPTION OF CERTAIN INVENTIVE EMBODIMENTS

Embodiments will be described more fully hereinafter with reference to the accompanying drawings. This invention may, however, be embodied in many different forms and should not be construed as being limited to the embodiments set forth herein; rather, these embodiments are provided so that this disclosure will be thorough and complete. In the following, when a part is recited as coupled with another part, it means that not only may it be coupled directly with another part, but also that it may be coupled to another device intervened between.

In general, an organic light emitting diode display panel displays an image by voltage-driving or current-driving N by M organic light emitting cells arranged in a matrix form.

Figure 1:
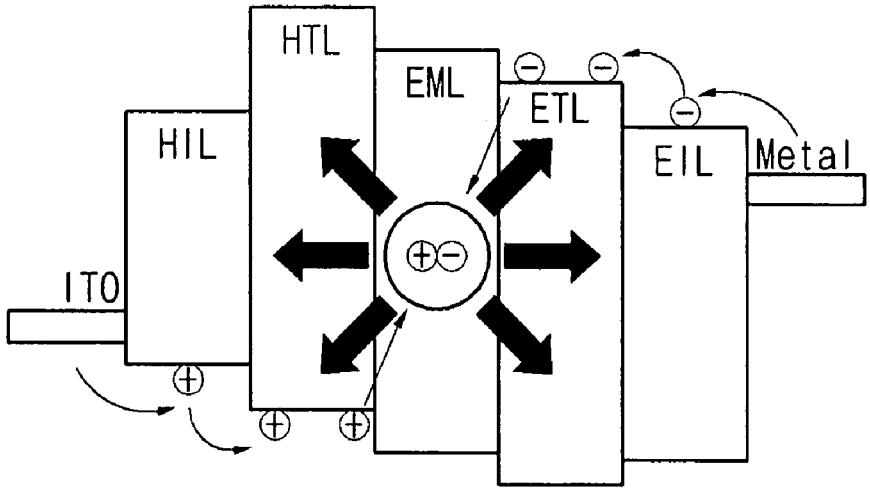
FIG. 1 is a schematic drawing depicting the schematic structure of a conventional organic light emitting diode.

As shown in FIG. 1, an organic light emitting diode which has diode-like characteristics (called an OLED in general) consists of an anode (ITO), an organic thin layer (an organic layer) and a cathode (Metal). The organic thin layer can, for example be formed in a multiple layer structure, which includes an emission layer (EML), an electron transport layer (ETL) and a hole transport layer (HTL), for improving the luminous efficiency by ameliorating the balance of a hole. In addition to the structure mentioned above, an electron injecting layer (EIL) can also be formed on one side of the electron transport layer, and a hole injecting layer (HIL) can be formed on one side of the hole transport layer as well.

In the case of a phosphorescent organic light emitting diode, a hole blocking layer (HBL) can be selectively formed between the emission layer (EML) and the electron transport layer (ETL), and an electron blocking layer (EBL) can be selectively formed between the emission layer (EML) and the hole transport layer (HTL).

The organic thin layer (an organic layer) can be formed in a slim organic light emitting diode(a slim OLED) structure in which the thickness of the organic light emitting diode can be reduced by mixing two different kinds of layers. For example, a hole injection transport layer (HITL), in which the hole injecting layer and the hole transport layer are formed simultaneously, and an electron injection transport layer (EITL), in which the electron injecting layer and the electron transport layer are formed simultaneously, can be selectively formed. One aspect of the slim organic light emitting diode is to improve the luminous efficiency.

A buffer layer can be selectively formed between the anode and the emission layer (EML). The buffer layer can be classified into an electron butter layer for buffering an electron and a hole buffer layer for buffering a hole. The electron buffer layer can be selectively formed between the cathode and the electron injecting layer (EIL), and it can replace the feature of the electron injecting layer (EIL). Here, the stack structure of the organic thin layer can be the following, an emission layer (EML)/ an electron transport layer (ETL)/ an electron buffer layer/ a cathode. Furthermore, the hole buffer layer can be selectively formed between the anode and the hole injecting layer HIL, and it can function similar to the hole injecting layer (HIL). Here, the stack structure of the organic layer can be the following, an anode/ a hole buffer layer/ a hole transport layer (HTL)/ an emission layer (EML).

The following is the possible stack structures for the structure mentioned above.

a) Normal Stack Structure
   1) an anode/ a hole injecting layer/ a hole transport layer/ an emission layer/ an electron transport layer/ an electron injecting layer/ a cathode
   2) an anode/ a hole buffer layer/ a hole injecting layer/ a hole transport layer/ an emission layer/ an electron transport layer/ an electron injecting layer/ a cathode
   3) an anode/ a hole injecting layer/ a hole transport layer/ an emission layer/ an electron transport layer/ an electron injecting layer/ an electron buffer layer/ a cathode
   4) an anode/ a hole buffer layer/ a hole injecting layer/ a hole transport layer/ an emission layer/ an electron transport layer/ a electron injecting layer/ an electron buffer layer/ a cathode
   5) an anode/ a hole injecting layer/ a hole buffer layer/ a hole transport layer/ an emission layer/ an electron transport layer/ an electron injecting layer/ a cathode
   6) an anode/ a hole injecting layer/ a hole transport layer/ an emission layer/ an electron transport layer/ an electron buffer layer/ an electron injecting layer/ a cathode b) Normal Slim Structure
   1) an anode/ a hole injection transport layer/ an emission layer/ an electron transport layer/ an electron injecting layer/ a cathode
   2) an anode/ a hole buffer layer/ a hole injection transport layer/ an emission layer/ an electron transport layer/ an electron injecting layer/ a cathode
   3) an anode/ a hole injecting layer/ a hole transport layer/ an emission layer/ an electron injection transport layer/ an electron buffer layer/ a cathode
   4) an anode/ a hole buffer layer/ a hole transport layer/ an emission layer/ an electron injection transport layer/ an electron buffer layer/ a cathode
   5) an anode/ a hole injection transport layer/ a hole buffer layer/ an emission layer/ an electron transport layer/ an electron injecting layer/ a cathode
   6) an anode/ a hole injecting layer/ a hole transport layer/ an emission layer/ an electron buffer layer/ an electron injection transport layer/ a cathode c) Inverted Stack Structure
   1) a cathode/ an electron injecting layer/ an electron transport layer/ an emission layer/ a hole transport layer/ a hole injecting layer/ an anode
   2) a cathode/ an electron injecting layer/ an electron transport layer/ an emission layer/ a hole transport layer/ a hole injecting layer/ a hole buffer layer/ an anode
   3) a cathode/ an electron buffer layer/ an electron injecting layer/ an electron transport layer/ an emission layer/ a hole transport layer/ a hole injecting layer/ an anode
   4) a cathode/ an electron buffer layer/ an electron injecting layer/ an electron transport layer/ an emission layer/ a hole transport layer/ a hole buffer layer/an anode 5) a cathode/ an electron injecting layer/ an electron transport layer/ an emission layer/ a hole buffer layer/ a hole injecting layer/ an anode
6) a cathode/ an electron injecting layer/ an electron buffer layer/ an electron transport layer/ an emission layer/ a hole transport layer/ a hole injecting layer/ an anode d) Inverted Slim Structure
1) a cathode/ an electron injecting layer/ an electron transport layer/ an emission layer/ a hole injecting layer/ an anode
2) a cathode/ an electron injecting layer/ an electron transport layer/ an emission layer/ a hole injection transport layer/ a hole buffer layer/ an anode
3) a cathode/ an electron buffer layer/ an electron injection transport layer/ an emission layer/ a hole transport layer/ a hole injecting layer/ an anode
4) a cathode/ an electron buffer layer/ an electron injection transport layer/ an emission layer/ a hole transport layer/ a hole injecting layer/ an anode
5) a cathode/ an electron injecting layer/ an electron transport layer/ an emission layer/ a hole buffer layer/ a hole injection transport layer/ an anode
6) a cathode/ an electron injection transport layer/ an electron buffer layer/ an emission layer/ a hole transport layer/ a hole injecting layer/ an anode Here, a cathode means a negative electrode, and an anode means a positive electrode.

In addition, the organic light emitting display can be a voltage programming organic light emitting display or a current programming organic light emitting display according to the kind of the data written on a data line.

A passive matrix method and an active matrix method are well known driving methods for driving the organic light emitting diode. The passive matrix method has merits in that the fabricating process is simple, and the investment is small because an anode and a cathode are formed to be crossing each other in an orthogonal direction. In addition, the organic light emitting diode is driven as a line is selected. However, it also has a weakness in that the current consumption can be large when an image is displayed on a large size display. The active matrix method has merits in that the current consumption is small, and the image quality is excellent, and the life span is long, and it can be enlarged to a medium or large size because an active element and a storage capacitor such as a thin film transistor are formed on each pixel.

Figure 2:
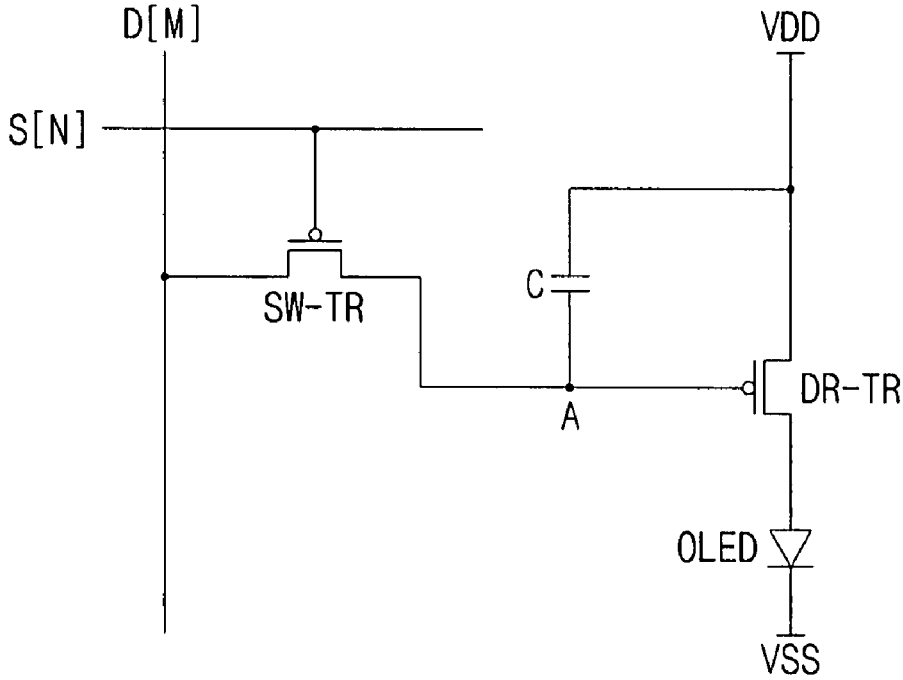
FIG. 2 is a schematic drawing depicting a pixel circuit of a voltage driving type.
Figure 3:
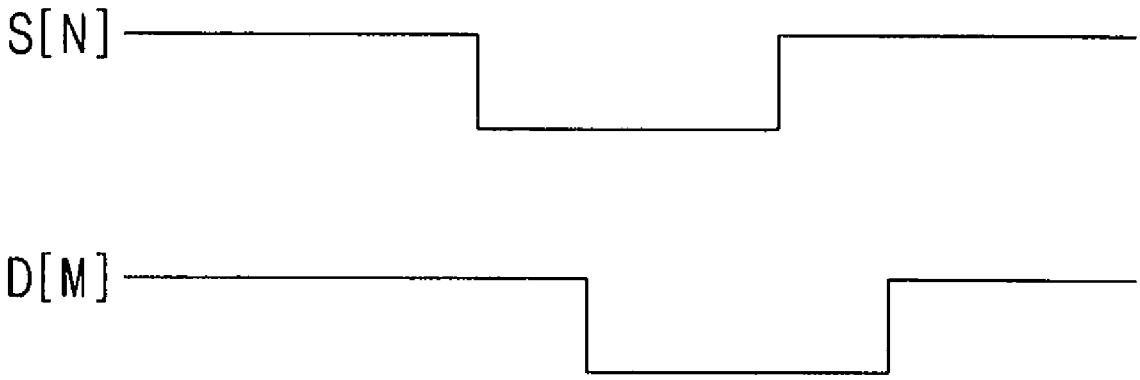
FIG. 3 is a driving timing diagram of the pixel circuit shown in FIG. 2.

As described above, in the case of the active matrix method for a pixel circuit based on, an organic light emitting diode and a thin film transistor are used. Here, an amorphous silicon thin film transistor or a poly silicon thin film transistor can be used as the thin film transistor. Referring to FIG. 2, a pixel circuit of an organic light emitting display is depicted. Referring to FIG. 3, a driving timing diagram of the pixel circuit shown in FIG. 2 is depicted. The pixel circuit is a pixel circuit shown as a representative of one of the N by M pixels.

As shown in FIG. 2, a pixel circuit of an organic light emitting display includes a scan line (S[N]) for supplying a scan signal; a data line (D[M]) for supplying a data signal; a first power supply line (VDD) for supplying a first power supply voltage; a second power supply line (VSS) for supplying a second power supply voltage; a driving transistor (DR_TR); a switching transistor (SW_TR); a storage capacitor (C); and an organic light emitting diode (OLED). Here, the first power supply voltage can be determined to have a relatively higher voltage level than that of the second power supply voltage.

The operation of the pixel circuit described above during one frame will be described with reference to FIG. 3.

As shown in FIG. 3, a scan signal is supplied, and then a data signal is supplied after an interval. The interval is used is to secure a margin from the time when a switching transistor is turned on by supply of a scan signal to the time when a data signal is supplied. The pixel circuit of FIG. 2 will be described again with reference to the timing diagram of FIG. 3. Once a scan signal is supplied from the scan line (S[N]), the switching transistor (SW_TR) is turned on. Accordingly, a data signal from the data line (D[M]) is supplied to a control electrode of the driving transistor (DR_TR) and a first electrode (A) of the storage capacitor (C). Therefore, a first power supply voltage from the first power supply line (VDD) is supplied to the organic light emitting diode (OLED) through the driving transistor (DR-TR), and consequently, the organic light emitting diode (OLED) emits light with a uniform luminance during a frame. Because the data voltage supplied from the data line (D[M]) is stored in the storage capacitor (C), even if supply of a scan signal from the scan line (S[N]) is blocked, the driving transistor (DR_TR) can stay turned on during the frame.

In case that RGB data signals are applied to pixel circuits using a demux, if the emission control signals (the signals from the EM[N]) coupled to the pixel circuits are turned off, then the RGB data signals can be stored in a storage capacitor of the pixel circuit improperly. That is to say, in case that the RGB data signals (voltages) are applied by driving a demux continuously on the condition that RGB data signals (voltages) which are already stored in the storage capacitors are not yet initialized, it can cause a problem in that proper RGB data signals (voltages) are not stored in the storage capacitors.

In case that a voltage driving is used in the conventional structure mentioned above, a high grey scale cannot be accomplished easily because of the irregularity of the threshold voltage (Vth) of the thin film transistor (TFT) used as a driving transistor. For example, in case that a pixel is driven with 3V range, an about 12 mV step is required to express an 8 bit (256) grey scale because 3 divided by 256 is about 12 mV. On the contrary, in the case of the thin film transistor, a high grey scale cannot be expressed easily because the variation of the threshold voltage (Vth) of the thin film transistor is about 100 mV.

Because a current for driving the organic light emitting diode (OLED) is supplied by the first power supply line (VDD), as the number of the pixels increases, the amount of the current supplied by the first power supply line (VDD) should increase as well. Consequently, as the number of the pixels in row direction increases, IR-drop occurs at a VDD supplying line according to the resistance of the line (that is, $V=I\times R$). Accordingly, as Vgs of the thin film transistor placed in each pixel is changed, the difference of the current of the organic light emitting diode (OLED) is caused. The difference of the current becomes more serious as the size of the display becomes larger, thus, the non-uniformity of the image quality is caused.

To compensate for the threshold voltage (Vth) and IR-drop of the VDD line mentioned above, various forms of pixel circuits can be composed. However, the pixel circuits can be complicated, and the complicated circuit makes it difficult to accomplish high integration. It is high integration that can realize high resolution, consequently, simplification of a pixel circuit is a beneficial task to realizing an organic light emitting display of high resolution.

In addition, the materials used as an organic light emission layer (for example, DCM2, quinacridone, DPVBi, and so on) can be degraded by the heat generated during self emission. Because of the degradation, the luminance of the organic light emitting diode can deteriorate. As a result, the life span of the organic light emitting diode can be decreased.

Because the rate of the degradation of an organic light emission layer forming a red, green and blue organic light emission layer differs from one another, the difference of the luminance of the red, green and blue organic light emission layer can become larger as time goes by. Accordingly, the color wanted may not be reproduced because a transition of the color occurs as the white balance is changed over time.

To solve the problems mentioned above, an organic light emitting display and a method for driving the organic light emitting display can include a demux which includes a plurality of RGB switching transistors which apply a data voltage through RGB data lines as the RGB switching transistors are coupled to the respective RGB data lines, and a plurality of RGB pixel circuits coupled to the RGB switching transistors of the demux. In addition, the RGB data voltage of the demux can be applied during a period which a turn-on emission control signal is applied to the RGB pixel circuits.

The respective RGB pixel circuits can be coupled to a common scan line and a common emission control line. The respective RGB pixel circuits can be coupled to a common first power supply line and a common second power supply line. A turn-on scan signal can be applied to the RGB pixel circuits during a period which the RGB data voltage of the demux is applied. A turn-off scan signal can be applied to the RGB pixel circuits during a period which the RGB data voltage of the demux is applied.

The RGB pixel circuits can include a first switching transistor which is coupled to a scan line and a data line, and whose control electrode is coupled to the scan line, and which is coupled between a control electrode of a driving transistor and the data line; a driving transistor which is coupled between a first power supply line and a second power supply line, and whose control electrode is coupled to the first switching transistor; a first storage capacitor coupled between the first switching transistor, the first power supply line and the driving transistor; a second switching transistor which is coupled between the first power supply line and the driving transistor, and whose control electrode is coupled to an emission control line; a second storage capacitor coupled between the first switching transistor, the first storage capacitor, the second switching transistor and the driving transistor; and an organic light emitting diode coupled between the driving transistor and the second power supply line.

The first switching transistor can include a control electrode coupled to the scan line, a first electrode coupled to the data line, and a second electrode coupled to a control electrode of the driving transistor. The first switching transistor can apply a data in a direction from the first electrode to the second electrode as the control electrode of the first switching transistor is coupled to the scan line.

The driving transistor can include a control electrode coupled to the second electrode of the first switching transistor, a first electrode coupled to a second electrode of the second switching transistor, and a second electrode coupled to an anode of the organic light emitting diode. The driving transistor can control a driving current from the first power supply line as the control electrode of the driving transistor is coupled to the second electrode of the first switching transistor.

The first storage capacitor can include a first electrode coupled to the first power supply line, and a second electrode coupled to the second electrode of the first switching transistor and the control electrode of the driving transistor. The first storage capacitor can include a first electrode coupled to the first power supply line and a second electrode coupled to a second electrode of the second storage capacitor.

The second switching transistor can include a control electrode coupled to the emission control line, a first electrode coupled to the first power supply line, and a second electrode coupled to the first electrode of the driving transistor. The second switching transistor can include a control electrode coupled to the emission control line, a first electrode coupled to the first power supply line, and a second electrode coupled to a first electrode of the second storage capacitor.

The second storage capacitor can include a first electrode coupled to the second electrode of the second switching transistor and the first electrode of the driving transistor, and a second electrode coupled to the second electrode of the first storage capacitor, the second electrode of the first switching transistor and the first electrode of the driving transistor. The second storage capacitor can be coupled between the control electrode of the driving transistor and the first electrode of the driving transistor.

The organic light emitting diode can include an anode coupled to the second electrode of the driving transistor and a cathode coupled to the second power supply line.

The first switching transistor, the second switching transistor and the driving transistor can be N type channel transistors. The first switching transistor, the second switching transistor and the driving transistor can be P type channel transistors.

The organic light emitting diode includes an emission layer, and the emission layer can be any one selected from a fluorescent or a phosphorescence material, or a mixture of them.

The emission layer can be any one selected from a red, green or blue emitting material, or a mixture of them.

The driving transistor can be any one selected from an amorphous silicon thin film transistor, a poly silicon thin film transistor, an organic thin film transistor and a nano thin film transistor.

The driving transistor can be a poly silicon transistor including any one selected from Ni, Cd, Co, Ti, Pd, and W.

A second power supply voltage of the second power supply line can be set to be lower than a first power supply voltage of the first power supply line. The second power supply voltage of the second power supply line can be a ground voltage.

Once the first switching transistor and the second switching transistor are turned on during displaying one frame, a data voltage from the data line is applied to the second electrode of the first storage capacitor, the second electrode of the second storage capacitor, and the control electrode of the driving transistor. In addition, the first power supply voltage from the first power supply line can be applied to the first electrode of the first storage capacitor and the first electrode of the second storage capacitor.

Once the first switching transistor is turned on, and the second switching transistor is turned off during displaying one frame, a data voltage from the data line is applied to the second electrode of the first storage capacitor, the second electrode of the second storage capacitor, and the control electrode of the driving transistor. In addition, a first power supply voltage from the first power supply line can be applied to the first electrode of the first storage capacitor.

Once the first switching transistor is turned off, and the second switching transistor is turned on during displaying one frame, the first power supply line, the driving transistor and the organic light emitting diode are coupled one another. Subsequently, a current can be applied in a direction from the anode to the cathode of the organic light emitting diode.

An emission control transistor can also be included between the driving transistor and the organic light emitting diode. The emission control transistor can include a control electrode coupled to the emission control line, a first electrode coupled to the second electrode of the driving transistor, and a second electrode coupled to the anode of the organic light emitting diode. The emission control transistor can be an N type channel transistor. The emission control transistor can be a P type channel transistor.

As described above, in the organic light emitting display and the driving method, an RGB data signal is applied by using a demux, the RGB data can be stored in each storage capacitor of pixel circuits properly by applying the RGB data signal during a period which an emission control signal is turned on regardless of either a scan signal turned on or off. In the driving method, the pixel circuit can be driven by applying the RGB data at the demux during a period which a scan signal and an emission control signal are turned on respectively.

In addition, the pixel circuit can also be driven by applying the RGB data signal at the demux during a period which a scan is turned off and an emission control signal is turned on. Consequently, the RGB data signal can be stored in the storage capacitors in the pixel circuit properly.

Embodiments will be described more fully hereinafter with reference to the accompanying drawings. This invention may, however, be embodied in many different forms and should not be construed as being limited to the embodiments set forth herein; rather, these embodiments are provided so that this disclosure will be thorough and complete.

Figure 4:
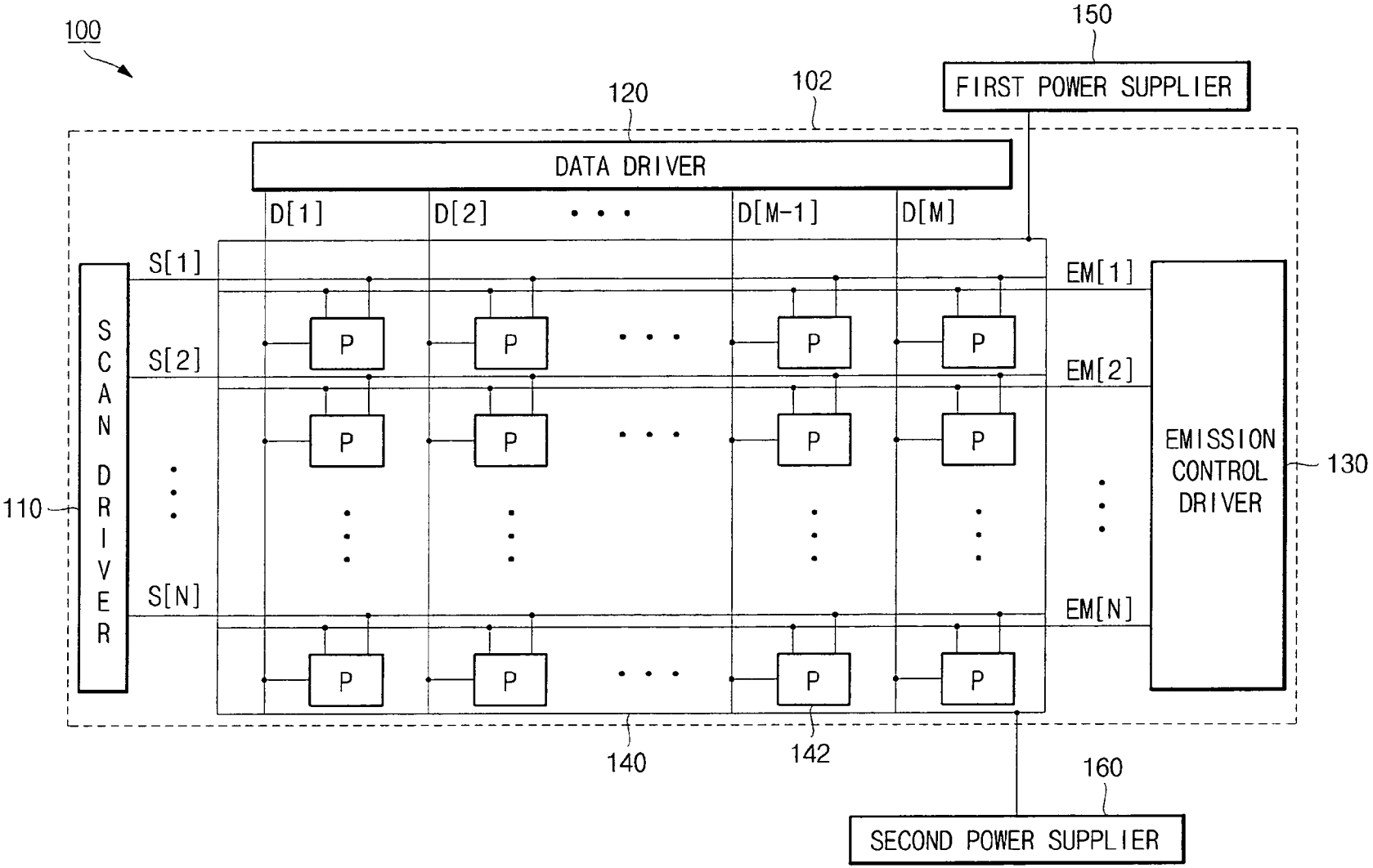
FIG. 4 is a block diagram of the structure of an organic light emitting display wherein a demux is not used.

Referring to FIG. 4, the composition of an organic light emitting display wherein a demux is not used is depicted in a block diagram.

As shown in FIG. 4, an organic light emitting display 100 can include a scan driver 110; a data driver 120; an emission control driver 130; an organic light emitting display panel 140 (hereinafter, called panel 140); a first power supplier 150; and a second power supplier 160.

The scan driver 110 can supply the panel 140 with a scan signal through a plurality of scan lines (S[1],,S[N]) in sequence.

The data driver 120 can supply the panel 140 with a data signal through a plurality of data lines (D[1] . . . D[M]).

The emission control driver 130 can supply the panel 140 with an emission control signal through a plurality of emission control lines (EM[1] . . . , EM[N]) in sequence.

In addition, the panel 140 can include a plurality of scan lines (S[1],,S[N]) arranged in row direction, a plurality of emission control lines (E[1], . . . E[M]) arranged in row direction, a plurality of data lines (D[1], . . . D[M]) arranged in column direction, and a pixel circuit (142, Pixel) which is near the intersections of the scan lines (S[1],,S[N]), the emission control lines (EM[1] . . . , EM[N]) and the data lines (D[1], . . . D[M]).

Here, the pixel circuit (140, Pixel) can be formed at the pixel region which is defined by the scan lines and the data lines. As described above, the scan lines (S[1],,S[N]) can be supplied with a scan signal from the scan driver 110, and the data lines (D[1], . . . D[M]) can be supplied with a data signal from the data driver 120, and the emission control signal line (EM[1] . . . , EM[N]) can be supplied with an emission control signal from the emission control driver 130.

The first power supplier 150 and the second power supplier 160 play a role of supplying each pixel circuit 142 placed at the panel 140 with a first power supply voltage and a second power supply voltage.

As shown in FIG. 4, the scan driver 110, the data driver 120, the emission control driver 130, the panel 140, the first power supplier 150 and the second power supply voltage driver 140 can be formed on one substrate 102.

Particularly, the drivers and power supply voltage suppliers 110, 120, 130, 150 and 160 can be formed at least partly on the same layer as the layer on which the scan lines (S[1],,S[N]), the data lines (D[1], . . . D[M])), the emission control lines (EM[1] . . . , EM[N]), and a transistor(not shown in drawings) of the pixel circuit 142 are formed. The drivers and the power supply voltage suppliers 110, 120, 130, 150 and 160 can alternatively be formed on another substrate (not shown in drawings), which can be coupled to the substrate 102. Furthermore, the drivers and the power supply voltage suppliers 110, 120, 130, 150 and 160 can be formed in a type selected from TCP (Tape Carrier Package), FPC (Flexible Printed Circuit), TAB (Tape Automatic Bonding), COG (Chip On Glass), and the equivalent thereof, which couple the drivers and the suppliers to the substrate 102. However, the form and the location of the drivers and the suppliers 110, 120, 130, 150 and 160 are not limited.

Figure 5:
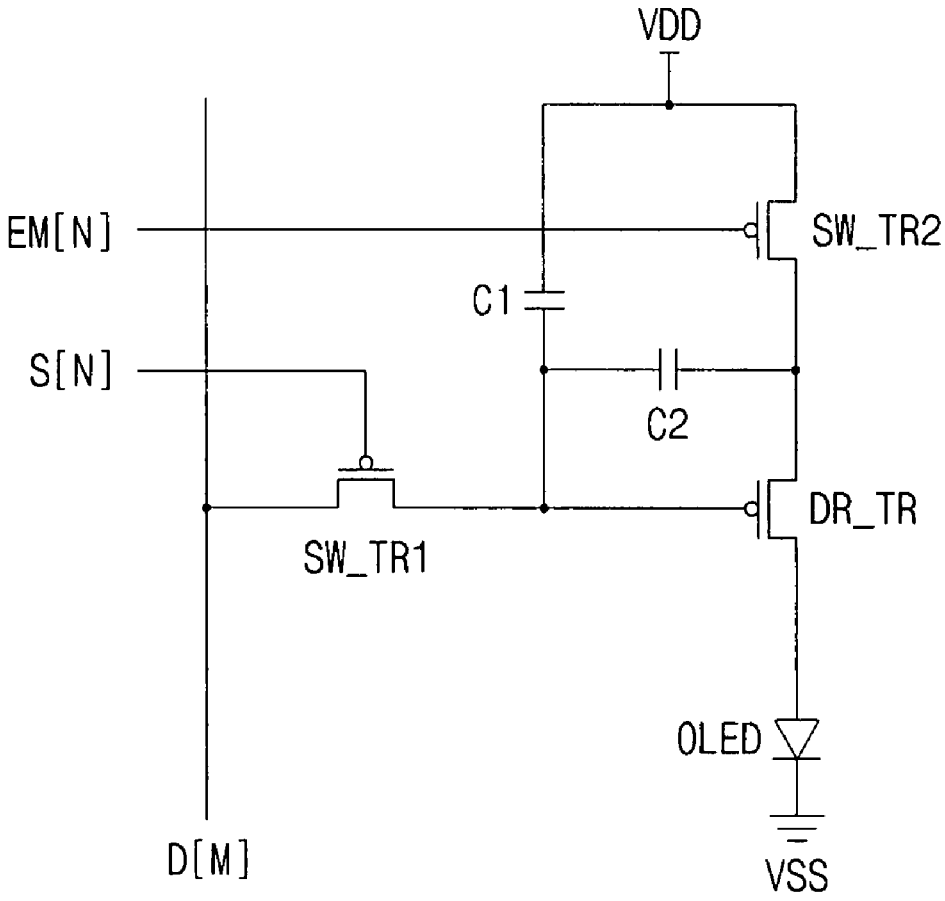
FIG. 5 is a circuit diagram depicting a pixel circuit according to an embodiment of an organic light emitting diode display.

Referring to FIG. 5, a pixel circuit of the organic light emitting display is depicted. The pixel circuits which will be described in the following may be used as one of the pixels of the organic light emitting displays 100.

As shown in FIG. 5, the pixel circuit of the organic light emitting display can include a scan line (S[N]); a data line (D[M]); an emission control line (EM[N]); a first power supply line (VDD); a second power supply line (VSS); a first switching transistor (SW_TR1); a second switching transistor (SW_TR2); a driving transistor (DR_TR); a first storage capacitor (C1); a second storage capacitor (C2); and an organic light emitting diode (OLED).

The scan line (S[N]) supplies a control electrode of the first switching transistor (SW_TR1) with a scan signal which selects an organic light emitting diode (OLED) which will be turned on. The scan line (S[N]) can be coupled to the scan driver 110 (referring to FIG. 4) which generates a scan signal.

The data line (D[M]) supplies a second electrode of the first storage capacitor, a second electrode of the second storage capacitor, and a control electrode of the driving transistor (DR_TR) with a data signal(voltage) which is in proportion to the luminance. The data line (D[M]) can be coupled to the data driver 120 (referring to FIG. 4) which generates a data signal.

The emission control line (EM[N]) supplies a control electrode of the second switching transistor (SW_TR2) with an emission control signal as it is coupled to the control electrode of the second switching transistor (SW_TR2). Once the second switching transistor (SW-TR2) is turned on by the emission control signal, a first power supply voltage from the first power supply line (VDD) can be applied to a first electrode of the first storage capacitor (C1), a first electrode of the second storage capacitor (C2) and a first electrode of the first driving transistor (DR_TR). Undoubtedly, the emission control line (EM[N]) can be coupled to the emission control driver 130 (referring to FIG. 4) which generates an emission control signal.

The first power supply line (VDD) supplies the organic light emitting diode (OLED) with a first power supply voltage. The first power supply line (VDD) can be coupled to the first power supplier 150 (referring to FIG. 4) which supplies a first power supply voltage.

The second power supply line (VSS) supplies the organic light emitting diode (OLED) with a second power supply voltage. The second power supply line (VSS) can be coupled to the second power supplier 160 (referring to FIG. 4) which supplies a second power supply voltage. Here, the first power supply voltage can have a higher voltage level than that of the second power supply voltage.

In addition, the second power supply voltage can be a ground voltage.

The first switching transistor (SV_TR1) can include a first electrode (source or drain electrode) coupled to the data line (D[M]); a second electrode (source or drain electrode) coupled to a control electrode (gate electrode) of the driving transistor(DR_TR), a second electrode of the first storage capacitor (C1) and a second electrode of the second storage capacitor (C2); and a control electrode (gate electrode) coupled to the scan line (S[N]). The first switching transistor (SW_TR1) can be a P type channel transistor. Once the first switching transistor (SW_TR1) is turned on by the scan signal of low level applied to the control electrode through the scan line (S[N]), the first switching transistor (SW_TR1) applies a data voltage to a second electrode of the first storage capacitor (C1), a second electrode of the second storage capacitor (C2) and a control electrode of the driving transistor (DR_TR) through the data line (D[M]).

The driving transistor (DR_TR) can include a first electrode coupled to a first electrode of the second storage capacitor (C2) and a second electrode of the second switching transistor (SW_TR2); a second electrode coupled to an anode of the organic light emitting diode (OLED); and a control electrode coupled to the second electrode of the first switching transistor (SW_TR1), a second electrode of the first storage capacitor (C1) and a second electrode of the second storage capacitor (C2). The driving transistor can be a P type channel transistor. A method for driving the driving transistor (DR_TR), according to one embodiment, supplies an amount of current from the first power supply line (VDD) to the organic light emitting diode (OLED), once the driving transistor (DR_TR) is turned on by the signal of low level applied through the control electrode. A data signal is supplied to a storage capacitor, then it charges the storage capacitor, consequently, even if the electric connection with the data line (D[M]) is disconnected as the first switching transistor (SW_TR1) is turned off, a signal of low level can be applied to the control electrode of the driving transistor (DR_TR) during a fixed period continuously by the voltage charged in the storage capacitor.

Here, the driving transistor (DR_TR) can be any one selected from an amorphous silicon thin film transistor, a poly silicon thin film transistor, an organic thin film transistor, a nano thin film transistor, and the equivalent of them. However, the material or the kind of the driving transistor is not limited.

In case that the driving transistor (DR_TR) is a poly silicon thin film transistor, there are various crystallization methods such as an laser crystallization method (excimer laser annealing: ELA) using an excimer laser, a metal induced crystallization (MIC) using catalytic metals, a solid phase crystallization, a high pressure annealing wherein a crystallization is executed at a high temperature and a high humidity environment, and a sequential lateral solidification (SLS) using a mask in addition to a conventional laser crystallization.

Also available is micro silicon having a crystal grain size which is intermediate between that of amorphous silicon (a-Si) and that of poly silicon.

In general, the micro silicon has a crystal grain size ranging from 1 nm to 100 nm. The electron mobility of the micro silicon is from 1 to less than 50, and the hole mobility is from 0.01 to less than 0.2. The micro silicon has a smaller crystal grain size than that of poly silicon, and has small protrusions formed between crystal grains, compared with poly silicon, thus causing less hindrance during the electron transfer between crystal grains. Thus, the micro silicon can exhibit uniform properties. A thermal crystallization method and a laser crystallization method are the crystallization method of the micro silicon in general. The thermal crystallization method is performed by a method of depositing amorphous silicon and simultaneously obtaining a crystalline structure, or by a method of reheating.

The thin film transistor(TFT) can be formed by a method selected from the methods mentioned above and the equivalent of them, however, the fabricating method of the poly silicon thin film transistor is not limited.

The laser crystallization method is the most widely used crystallization method in which a thin film transistor is crystallized into poly silicon. Not only can the method directly use existing crystallization processes for poly silicon liquid crystal display devices, but also the process is simple, and the technology of the process has been completely established.

The metal induced crystallization method is one of the methods by which the crystallization can be accomplished at a low temperature without using the laser crystallization method. Initially, catalytic metals such as Ni, Co, Pd, and Ti are deposited or spin-coated on the surface of amorphous silicon, then the catalytic metals penetrate directly into the surface of the amorphous silicon. Consequently, it has an advantage in that the amorphous silicon can be crystallized at a low temperature while changing the phase of the amorphous silicon.

A modification of the metal induced crystallization method has an advantage in that when a metal layer is interposed on the surface of the amorphous silicon, the intervention of contaminants such as Nickel silicide in specific regions of the thin film transistor can be suppressed using a mask.

The crystallization method mentioned above is also called a metal induced lateral crystallization (MILC). A shadow mask can be used in the metal induced lateral crystallization, and the shadow mask can be a linear mask or a dot shaped mask.

Another modification of the metal induced crystallization method is a metal induced crystallization with capping layer (MICC), wherein when a catalytic metal layer is deposited or spin-coated on the surface of amorphous silicon, a capping layer is interposed first so that the amount of the catalytic metal flowing into the amorphous silicon can be controlled. A silicon nitride film can be used for the capping layer. The amount of the catalytic metal flowing from the catalytic metal layer into the amorphous silicon can change according to the thickness of the nitride layer. Here, the catalytic metal flowing into the silicon nitride film can be formed on the entire surface of the silicon nitride film, and it can also be formed selectively by using a shadow mask and the like. The capping layer can be removed selectively after the catalytic metal layer crystallizes the amorphous silicon into poly silicon. To remove the capping layer, a method of wet etching or dry etching can be used. Furthermore, after the poly silicon is formed, a gate insulating layer is formed, and then a gate electrode is formed on the gate insulating layer. An inter-layer dielectric layer can be formed on the gate electrode. After a via hole is formed on the inter-layer dielectric layer, impurities are introduced into the crystallized poly silicon phase through the via hole to further eliminate catalytic metal impurities dispersed in the poly silicon phase. This method of further eliminating catalytic metal impurities is referred to as a gettering process. The gettering process includes, in addition to a process of introducing the impurities, a heating process of heating thin film transistor. A high quality thin film transistor can be obtained through the gettering process.

Furthermore, in case that a driving transistor (DR_TR) is fabricated by the metal induced crystallization, the driving transistor (DR_TR) can also include any one selected from Ni, Cd, Co, Ti, Pd, W, Al, and the equivalent of them.

The organic light emitting diode (OLED) can include an anode coupled to the second electrode of the driving transistor (DR_TR) and a cathode coupled to the second power supply line (VSS). The organic light emitting diode (OLED) emits light in a predetermined luminance by the current controlled through the driving transistor (DR_TR) while the second switching transistor (SW_TR2) is turned on.

Here, the organic light emitting diode (OLED) includes an emission layer (not shown in drawings). The emission layer can be any one selected from a fluorescent material, a phosphorescent material, a mixture of them, and the equivalent of them. However, the material or the kind of the emission layer is not limited.

In addition, the emission layer can be one selected from a red emitting material, a green emitting material, a blue emitting material, a mixture of them, and the equivalent of them. However, the material or the kind of the emission layer is not limited.

The second switching transistor (SW_TR2) can include a first electrode coupled to the first power supply line (VDD) and a first electrode of the first storage capacitor (C1); a second electrode coupled to a first electrode of the second storage capacitor (C2) and the first electrode of the driving transistor (DR_TR); and a control electrode coupled to the emission control line (EM[N]). The second switching transistor (SW_TR2) can be a P type channel transistor. Once the second switching transistor (SW_TR2) is turned on by the signal of low level applied to the control electrode through the emission control line (EM[N]), it runs a current from the first power supply line (VDD) to the organic light emitting diode (OLED).

The first storage capacitor (C1) can include a first electrode coupled to the first power supply line (VDD) and the first electrode of the second switching transistor (SW_TR2), and a second electrode coupled to a second electrode of the second storage capacitor (C2), the second electrode of the first switching transistor (SW_TR1) and the control electrode of the driving transistor (DR_TR).

The second storage capacitor (C2) can include a first electrode coupled to the second electrode of the second switching transistor (SW_TR2) and the first electrode of the driving transistor (DR_TR), and a second electrode coupled to the second electrode of the first storage capacitor (C1), the second electrode of the first switching transistor (SW_TR1) and the control electrode of the driving transistor (DR_TR).

The storage capacitor maintains a data signal voltage and the threshold voltage of the driving transistor for a predetermined period. In addition, once the second switching transistor (SW_TR2) is turned on as a signal of low level is applied to the control electrode of the second switching transistor (SW_TR2) by the emission control line (EM[N]), the storage capacitor runs a current, which is in proportion to the strength of a data signal, from the first power supply line to the organic light emitting diode. Consequently, the organic light emitting diode emits light. Furthermore, the compensation for IR-drop or the threshold voltage of the driving transistor which will be described in the following can be accomplished by controlling the capacitance ratio (C1:C2) of the first storage capacitor to the second storage capacitor variously.

Here, all the first switching transistor (SW_TR1), the driving transistor (DR_TR) and the second switching transistor (SW_TR2) can be one selected from a P type channel transistor and its equivalent. However, the kind of the transistor is not limited to this exemplary embodiment.

Figure 6:
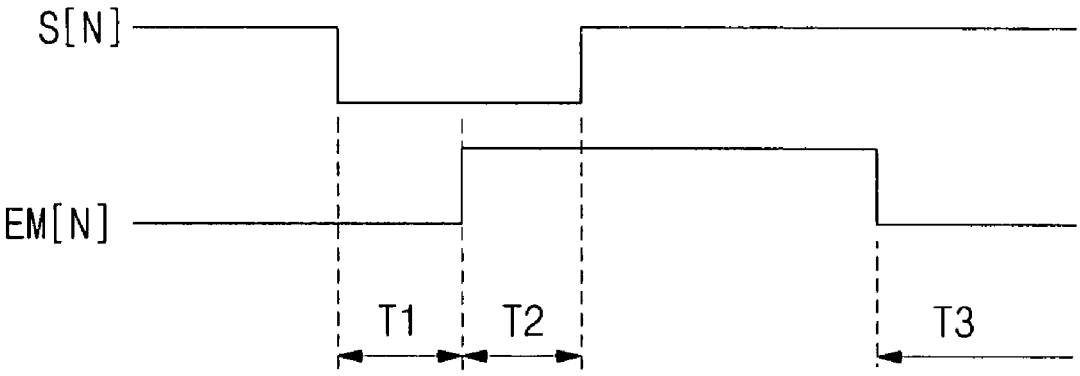
FIG. 6 is a driving timing diagram of the pixel circuit shown in FIG. 5.

Referring to FIG. 6, a driving timing diagram of the pixel circuit shown in FIG. 5 is depicted. As shown in FIG. 6, in the pixel circuit of the organic light emitting display, one frame can be classified into the first period, the second period and the third period. More particularly, one frame can consist of a data writing period (T1), a period for storing the threshold voltage of the driving transistor (T2), and an emission period (T3). Various ratios of the data writing period (T1) to the period for storing the threshold voltage of the driving transistor (T2) to the emission period (T3) can be formed. It may be beneficial that the data writing period (TI) and the period for storing the threshold voltage of the driving transistor (T2) are shorter than the emission period (T3).

Figure 7:
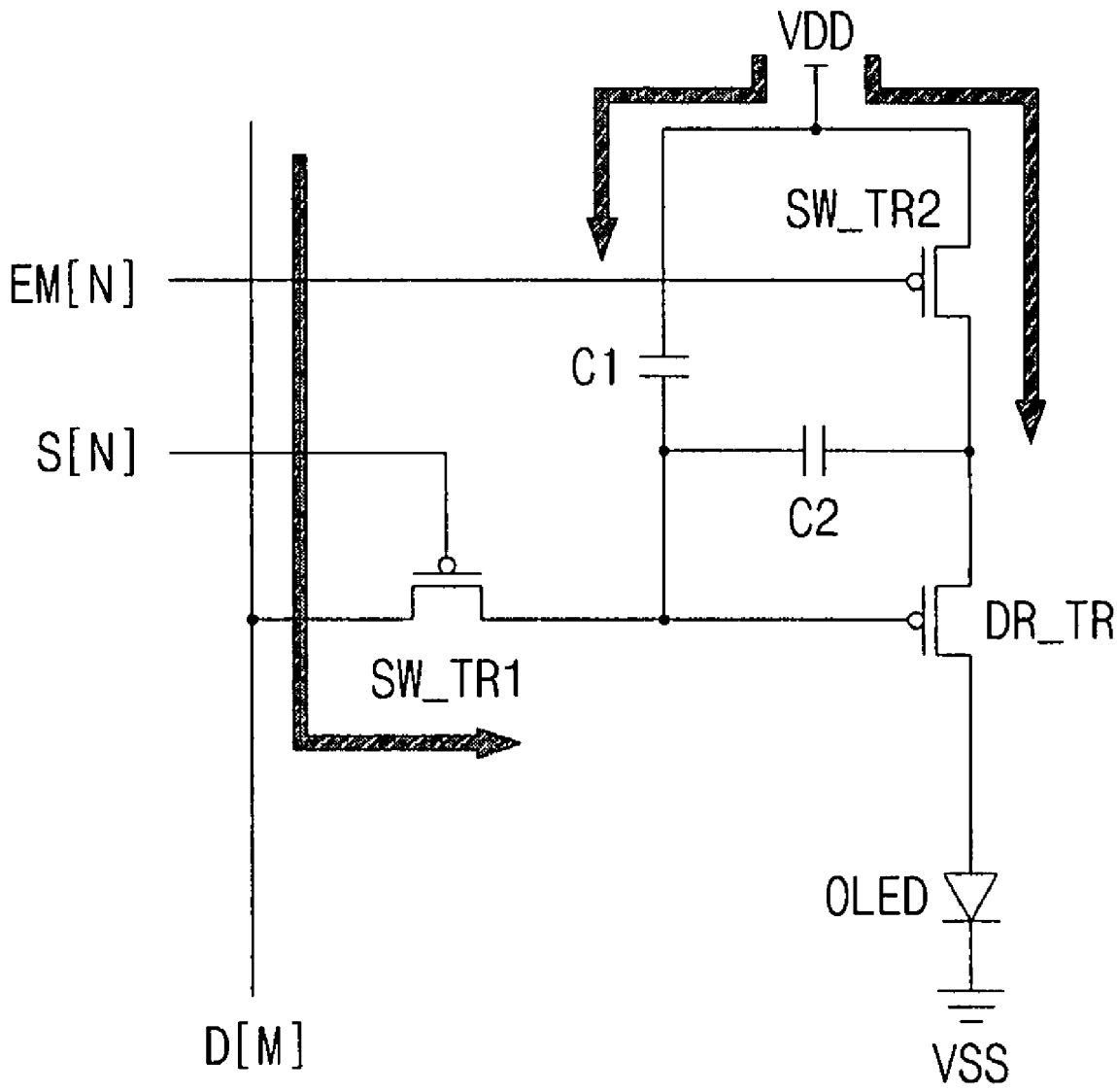
FIG. 7 is a drawing depicting how a current flows through the pixel circuit shown in FIG. 5 during the data writing period (T1).

Referring to FIG. 7, it is depicted how a current flows through the pixel circuit shown in FIG. 5 during the data writing period (T1). Here, the operation of the pixel circuit mentioned above will be described with reference to the timing diagram of FIG. 6.

First of all, the first switching transistor (SW_TR1) is turned on as a scan signal of low level is applied to the control electrode of the first switching transistor (SW_TR1). Then the second switching transistor (SW_TR2) is turned on as a signal of low level of the emission control line (EM[N]) is applied to the control electrode of the second switching transistor (SW_TR2).

As the first switching transistor (SW_TR1) is turned on, a data voltage (Vdata) of the data line (D[M]) is applied in a direction from the first electrode of the first switching transistor (SW_TR1) to the second electrode of the first switching transistor (SW_TR2). Consequently, the data voltage (Vdata) can be applied to the second electrode of the first switching transistor (SW_TR1), the second electrode of the first storage capacitor (C1), the second electrode of the second storage capacitor (C2) and the control electrode of the driving transistor (DR_TR).

Here, as the second switching transistor (SW_TR2) is turned on, a first power supply voltage from the first power supply line VDD is applied in a direction from the first electrode of the second switching transistor (SW_TR2) to the second electrode of the second switching transistor (SW_TR2). Consequently, the first power supply voltage can be applied to the second electrode of the second switching transistor (SW_TR2), the first electrode of the second storage capacitor (C2) and the first electrode of the driving transistor (DR_TR).

In addition, the first power supply voltage from the first power supply line (VDD) can also be applied to the first electrode of the first storage capacitor (C1).

During the data writing period (T1) described above, the driving transistor (DR_TR) is turned off, thus no current flows through the organic light emitting diode (OLED). Consequently, the organic light emitting diode (OLED) does not emit light.

That is to say, during the data writing period (T1), the voltage of Vdata (Vg=Vdata) is applied to the control electrode (gate electrode) of the driving transistor (DR_TR), the second electrode of the second storage capacitor (C2) and the second electrode of the first storage capacitor (C1). In addition, the voltage of VDD (Vs=VDD) is applied to the first electrode (source electrode) of the driving transistor (DR_TR), the first electrode of the second storage capacitor (C2) and the first electrode of the first storage capacitor (C1). Accordingly, the voltage (VDD−Vdata), wherein the data voltage (Vdata) is subtracted from the first power supply voltage (VDD), is stored in the storage capacitors.

Figure 8:
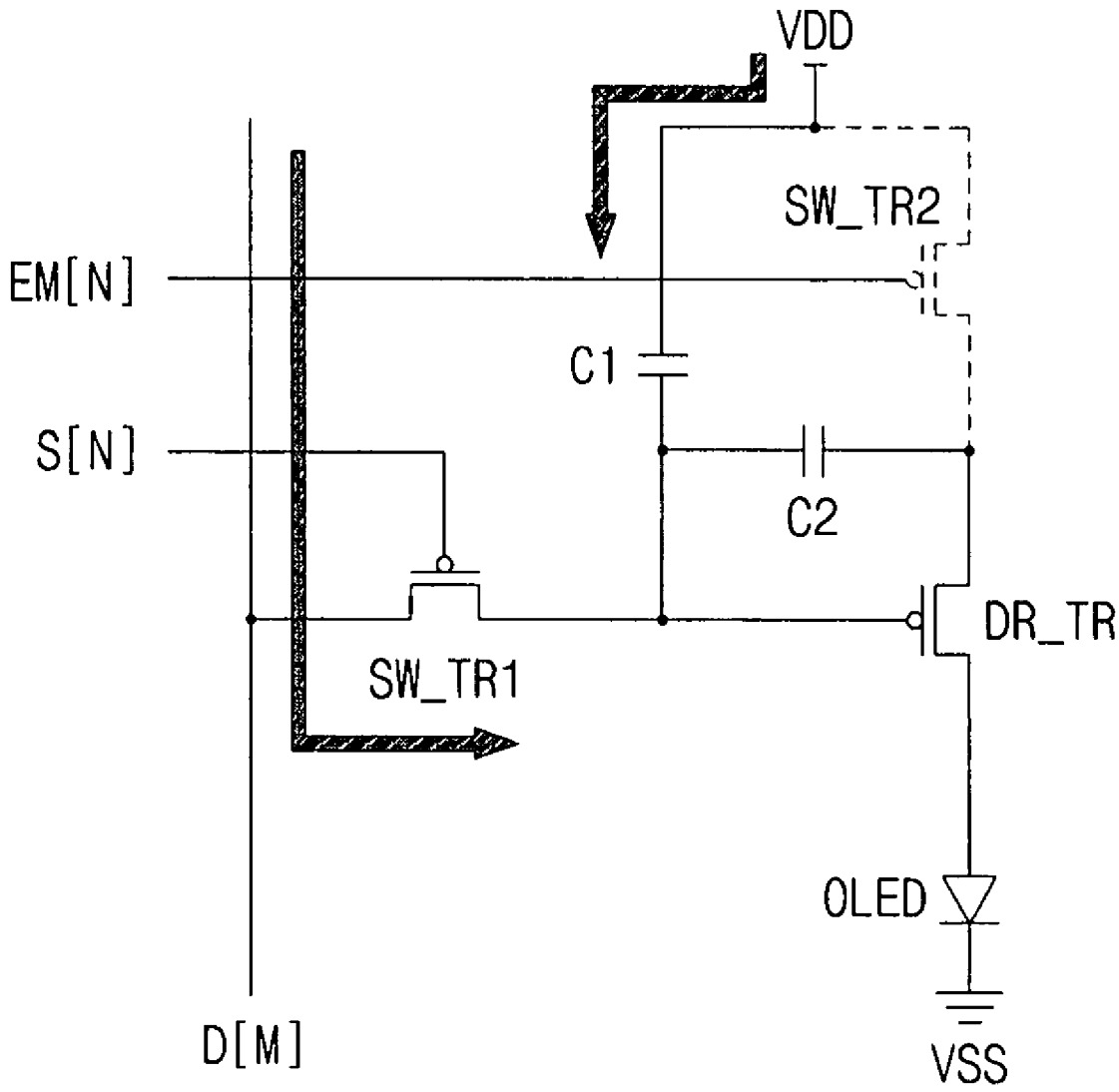
FIG. 8 is a drawing depicting how a current flows through the pixel circuit shown in FIG. 5 during the period for storing the threshold voltage of a driving transistor (T2).

Referring to FIG. 8, it is depicted how a current flows through the pixel circuit shown in FIG. 5 during storing the threshold voltage of the driving transistor (T2). Here, the operation of the pixel circuit will be described with reference to the timing diagram of FIG. 6.

First of all, the first switching transistor (SW-TR1) is turned on as a scan signal of low level from the scan line (S[N]) is applied to the control electrode of the first switching transistor (SW_TR1), and the second switching transistor (SW_TR2) is turned off as a signal of high level of the emission control line (EM[N]) is applied to the control electrode of the second switching transistor (SW_TR2).

As the first switching transistor (SW_TR1) is turned on, a data voltage (Vdata) of the data line (D[M]) is applied in a direction from the first electrode of the first switching transistor (SW_TR1) to the second electrode of the first switching transistor (SW_TR1). Consequently, the data voltage (Vdata) can be applied to the second electrode of the first switching transistor (SW_TR1), the second electrode of the first storage capacitor (C1), the second electrode of the second storage capacitor (C2) and the control electrode of the driving transistor (DR_TR).

Here, as the second switching transistor (SW_TR2) is turned off, a first power supply voltage from the first power supply line (VDD) can be applied only to the first electrode of the first storage capacitor (C1).

During storing the threshold voltage of the driving transistor (T2) described above, the driving transistor (DR_TR) is turned off, thus no current flows toward the organic light emitting diode (OLED). Consequently, the organic light emitting diode (OLED) does not emit light.

That is to say, during the period for storing the threshold voltage of the driving transistor (T2), the voltage of Vdata (Vg =Vdata) is applied to the control electrode (gate electrode) of the driving transistor (DR_TR), the second electrode of the second storage capacitor (C2) and the second electrode of the first storage capacitor (C1) In addition, the voltage of VDD is applied to the first electrode of the first storage capacitor (C1). Accordingly, the voltage (VDD−Vdata), wherein the data voltage (Vdata) is subtracted from the first power supply voltage (VDD), is stored in the first storage capacitor (C 1).

Here, the voltage (Vs) of the first electrode (source electrode) of the driving transistor (DR_TR) is a value (Vs=Vdata+Vth) wherein the data voltage (Vdata) is added to the threshold voltage (Vth) of the driving transistor (DR_TR). The voltage (Vth), wherein the voltage of the control electrode (the voltage of the gate electrode, Vg=Vdata) of the driving transistor (DR_TR) is subtracted from the voltage of the first electrode (the voltage of the source electrode, Vs=Vdata+Vth) of the driving transistor (DR_TR) is stored in the second storage capacitor (C2) during a fixed period.

Referring to the timing diagram of FIG. 6, between the second period (T2) and the third period (T3), the first switching transistor (SW_TR1) is turned off as a signal of high level is applied from the scan line (S[N]) to the control electrode of the first switching transistor (SW_TR1), and the second switching transistor (SW_TR2) is turned off as a signal of high level is applied from the emission control line (EM[N]) to the control electrode of the second switching transistor (SW_TR2).

Accordingly, during the period between the second period (T2) and the third period (T3), the voltage stored in the storage capacitor during the second period (T2) is maintained without any changes.

Figure 9:
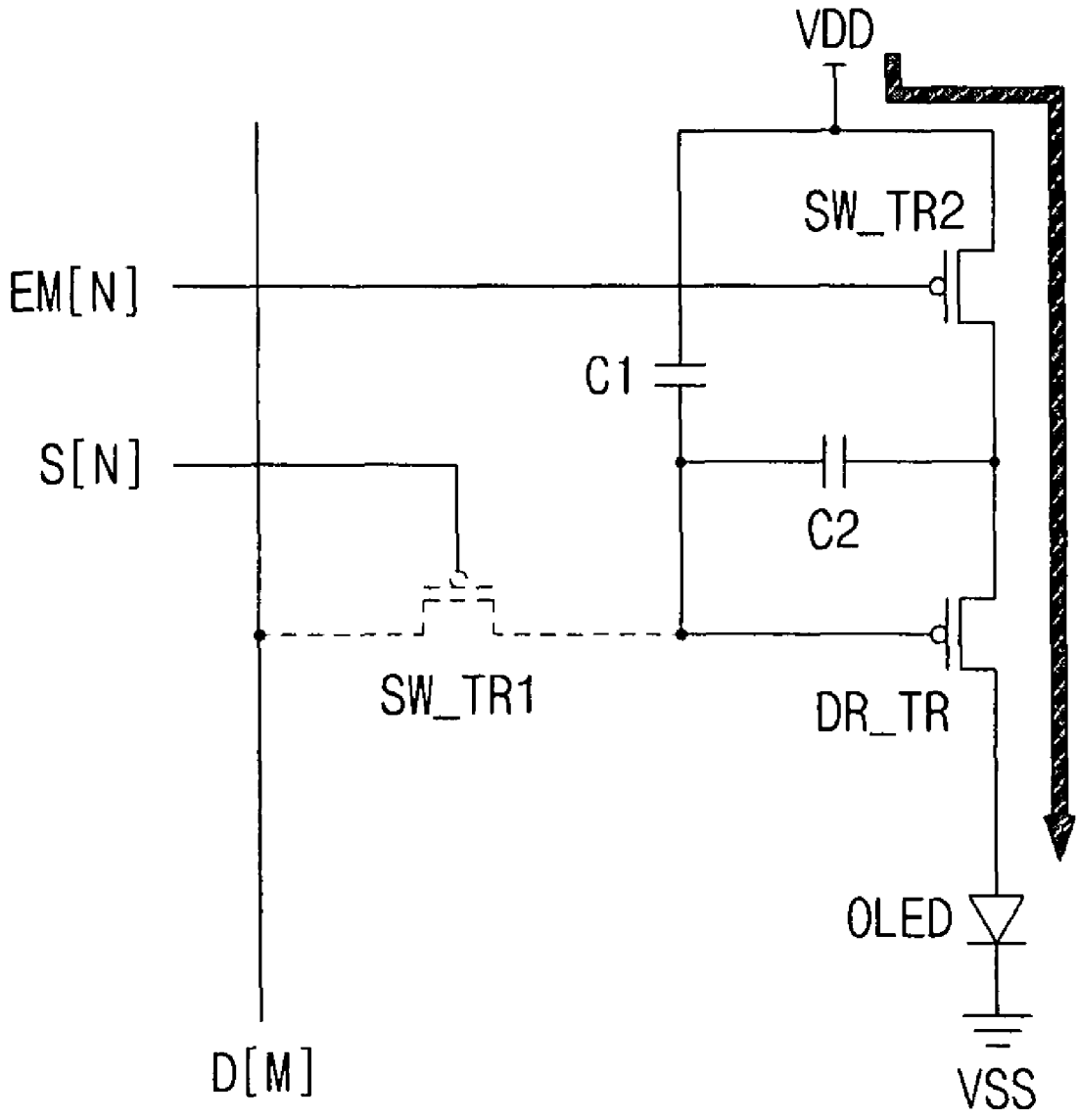
FIG. 9 is a drawing depicting how a current flows through the pixel circuit shown in FIG. 5 during the emission period (T3).

Referring to FIG. 9, it is depicted how a current flows through the pixel circuit shown in FIG. 5 during the emission period (T3). Here, the operation of the pixel circuit will be described with reference to the timing diagram of FIG. 6.

First of all, the first switching transistor (SW_TR1) is turned off as a signal of high level from the scan line (S[N]) is applied to the control electrode of the first switching transistor (SW_TR1), and the second switching transistor (SW_TR2) is turned on as a signal of low level of the emission control line (EM[N]) is applied to the control electrode of the second switching transistor (SW_TR2).

As the first switching transistor (SW_TR1) is turned off, a data voltage (Vdata) of the data line (D[M]) cannot be further applied to the pixel circuit.

Here, as the second switching transistor (SW_TR2) is turned on, a first power supply voltage from the first power supply line (VDD) is applied in a direction from the first electrode of the second switching transistor (SW_TR2) to the second electrode of the second switching transistor (SW_TR2). Consequently, the first power supply voltage can be applied to the first electrode (source electrode) of the driving transistor (DR_TR). A current by the first power supply line (VDD) can flow in a direction toward the second power supply line (VSS) through the organic light emitting diode (OLED) during the emission period (T3). Accordingly, the organic light emitting diode can emit light.

During the emission period (T3), the voltage(Vs) of the first electrode (source electrode) of the driving transistor (DR_TR) becomes VDD. In addition, the voltage(Vg) of the control electrode(gate electrode) of the driving transistor (DR_TR) and the voltage difference(Vsg) between the source electrode and the gate electrode of the driving transistor (DR_TR) can be calculated from the Formula 1 in the following.

$$V_g = V_{data} + \left(\frac{C2}{C1 + C2}\right) * (VDD - V_{data} - Vth) \quad \text{[Formula 1]}$$

$$V_S = VDD$$

$$V_{Sg} = V_S - V_g$$

$$V_{Sg} = VDD - \left[V_{data} + \left(\frac{C2}{C1 + C2}\right) * (VDD - V_{data} - Vth)\right]$$

Here, a current flowing through the organic light emitting diode (OLED) can be calculated from the Formula 2 in the following.

$$I_{OLED} = \frac{\beta}{2} * (V_{Sg} - |Vth|)^2 \quad \text{[Formula 2]}$$

That is to say, the threshold voltage (Vth) of the driving transistor (DR_TR) is stored in the second storage capacitor (C2) during the second period (T2). Subsequently, a data is expressed by the data voltage (Vdata) and the ratio of C1 to C2 during the emission period (T3).

Here, the optimal ratio of C1 to C2 can change according to the variation of the threshold voltage (Vth) of the driving transistor included in the respective pixel circuit. For example, in case that the variation of the threshold voltage (Vth) at the panel of the organic light emitting display is 0.1V, it can be said that the image quality has no problem. However, in case that the variation of the threshold voltage (Vth) during the fabricating process is 0.5V, a problem of the image quality can occur. In the case described above, if the ratio of C1 to C2 is set up as 1:5 (C1: C2=1:5), even if the variation of the threshold voltage (Vth) during the fabricating process is 0.5V, the variation of the threshold voltage (Vth) at the panel can become smaller than 0.1V. Consequently, the image quality has no problem.

If, C2 is set to have a larger value than that of C1 (that is, C2>>C1), C2 divided by C1 added to C2 (C2/(C1+C2)) can be approximately 1. Here, only Vth is left in Vsg in the formula 1 described above. In addition, when Vsg is substituted with Vth in Formula 2, the threshold voltage (Vth) of the driving transistor can be compensated to a current flowing through the organic light emitting diode (OLED).

If C2 is extremely larger than C1, then C2 divide by C1 added to C2 (C2/(C1+C2)) becomes 1, Vsg becomes Vth. Here, no matter how much Vdata changes, Vsg of the driving transistor (DR_TR) is Vth. Therefore, as shown in Formula 2, no data voltage (Vdata) appears in the Formula of the organic light emitting diode, it causes a problem in that the current wanted according to a data voltage (Vdata) cannot be generated. That is to say, it means the data range expands infinitely. Nevertheless, if C1 is set to have an extremely larger value than C2, then C2 divided by C1 added to C2 (C2/(C1+C2)) becomes 0 approximately. Consequently, Vsg in Formula I becomes VDD-Vdata. As a result, the current wanted can be generating according to a data voltage (Vdata). However, the compensation for the threshold voltage (Vth) of the driving transistor (DR_TR) or the compensation for IR-drop of the first power supply line (VDD) cannot be accomplished properly.

That is to say, the threshold voltage (Vth) of the driving transistor (DR_TR) and IR-drop by the first power supply line (VDD) can be compensated by controlling the ratio of C1 to C2.

For example, in case that C2 divided by C1 added to C2 (C2/(C1+C2)) is 0,5, Vgs becomes VDD−Vdata−0.5 VDD+0.5 Vdata+0.5 Vth. Consequently, the data range is increased twofold, and the influence of the threshold voltage (Vth) of the driving transistor (DR_TR) and IR-drop of the first power supply line (VDD) can be reduced to half. That is, the influence of the threshold voltage (Vth) of the driving transistor (DR_TR) and IR-drop of the first power supply line (VDD) can be minimized by determining C2 to have a larger value than C1.

Furthermore, conventional circuits for compensating the threshold voltage of a driving transistor and IR-drop of a first power supply line require more diodes than the pixel circuit according to these embodiments. Therefore, it can be difficult to accomplish high integration. However, the pixel circuit according to these embodiments can accomplish high integration because only three transistors and two storage capacitors may be used. Consequently, an organic light emitting display of high resolution can be realized.

In the case of a circuit for compensating the threshold voltage of a driving transistor in general, because a path is formed from a control electrode of the driving transistor to a negative power supply voltage, a leakage current can flow through the path. Here, in case that the leakage current(off current of the driving transistor) is large, although a black image should be expressed, improper emission can be generated by the leakage current which flows into the organic light emitting diode (OLED). Because the leakage characteristics of a driving transistor in a panel differ from one another, although a black image should be expressed, some pixels which have remarkable leakage characteristics can emit light. The improper emission described above can be reduced by having the driving transistor undergo a reverse aging because the reverse aging can reduce the leakage current of the driving transistor. However, the pixel circuit can include three transistors and two storage capacitors. Accordingly, a path through which a leakage current can flow from the control electrode of the driving transistor to the negative power supply voltage is not formed. Consequently, the reverse aging for the driving transistor described above is not required.

Preferably, the data writing period (T1) and the period for storing the threshold voltage of the driving transistor (T2) should be shorter than the emission period (T3) so that the time during which the organic light emitting diode (OLED) emits light can become longer.

Figure 10:
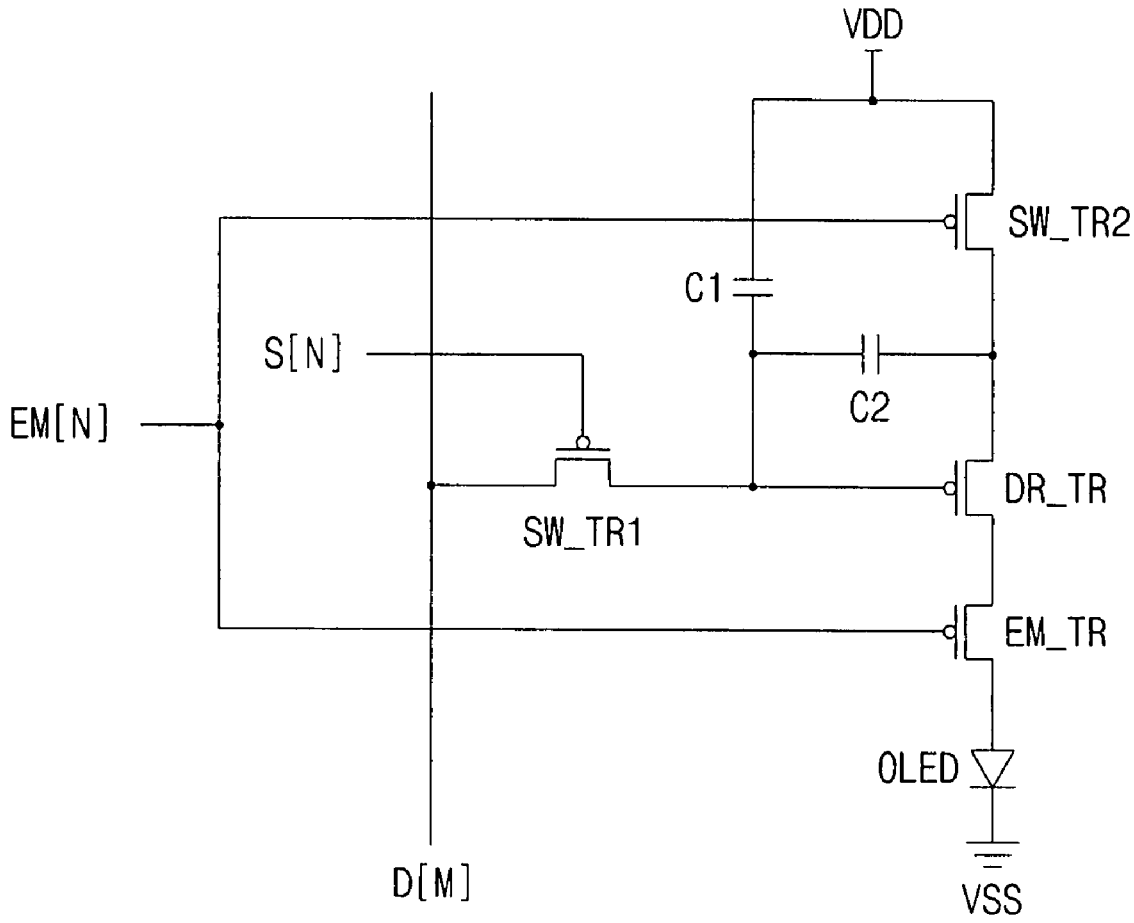
FIG. 10 is a circuit diagram depicting a pixel circuit according to an alternate embodiment of the organic light emitting display.

Referring to FIG. 10, a pixel circuit according to an alternate embodiment of the pixel circuit shown in FIG. 5 is depicted. The pixel circuit shown in FIG. 10 is similar to the pixel circuit shown in FIG. 5. However, the pixel circuit shown in FIG. 10 also includes an emission control switching transistor (EM_TR) in addition to the pixel circuit shown in FIG. 5.

The emission control switching transistor (EM_TR) includes a control electrode coupled to the emission control line (EM[N]), a first electrode coupled to the second electrode of the driving transistor, and a second electrode coupled to the anode of the organic light emitting diode (OLED). The emission control switching transistor can control a current which flows in a direction from the first power supply line (VDD) to the second power supply line (VSS) through the organic light emitting diode (OLED). That is to say, during the emission period (T3), the emission control signal switching transistor (EM_TR) is turned on as a signal of low level from the emission control line (EM[N]) is applied to the control electrode of the emission control switching transistor (EM_TR). Consequently, the organic light emitting diode (OLED) can emit light through a current which flows in a direction from the first power supply line (VDD) to the second power supply line (VSS) through the organic light emitting diode (OLED).

As shown in FIG. 10, a P type channel transistor can be used as the emission control switching transistor (EM_TR).

Figure 11:
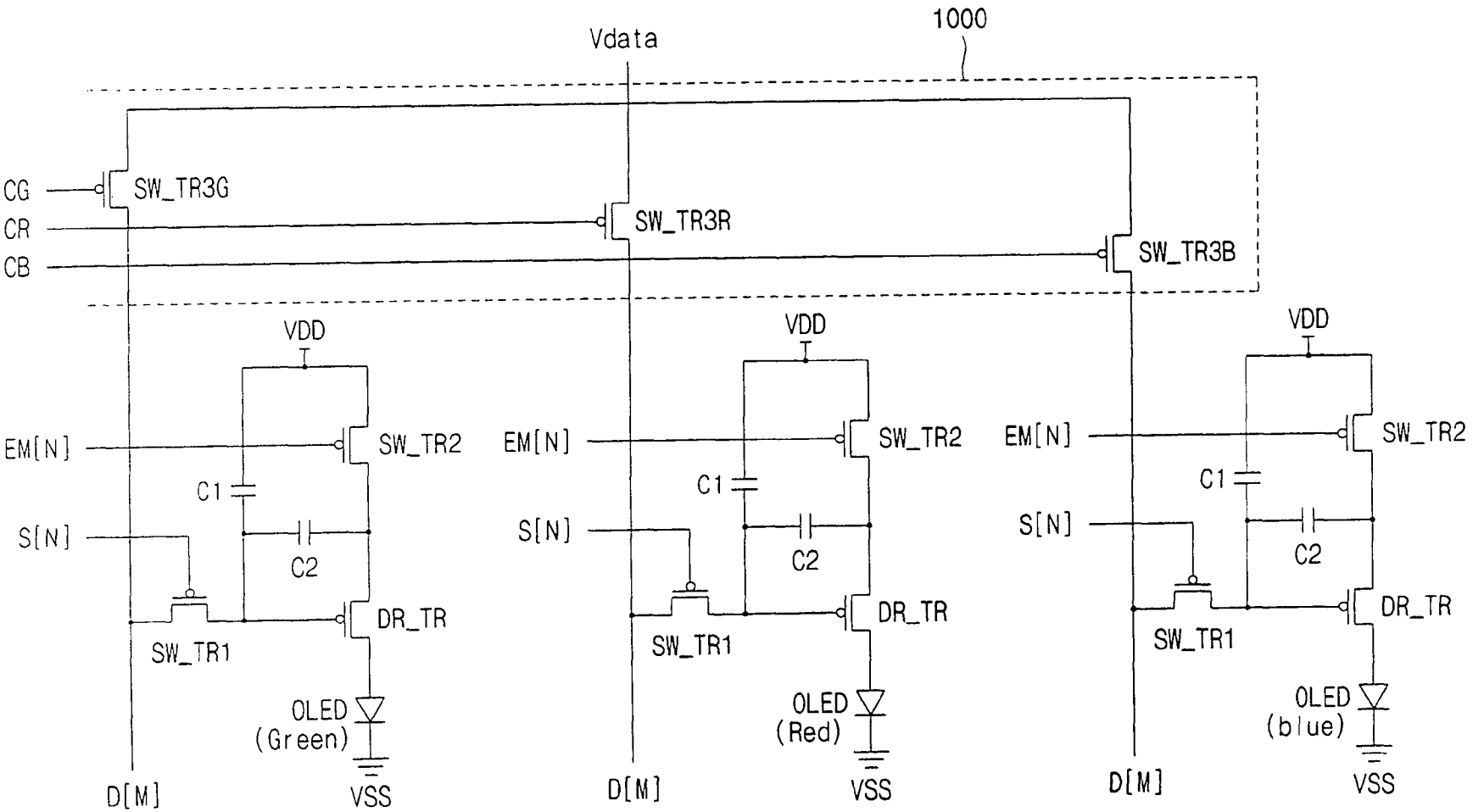
FIG. 11 is a drawing depicting how RGB pixel circuits and a demux are coupled according to an exemplary embodiment.

Referring to FIG. 11, it is depicted how RGB pixel circuits and a demux are coupled.

The demux 1000 is a demux which has a layout structure which corresponds to each RGB data signal of the data driver of the organic light emitting display.

Because high resolution is required, the number of data lines of the organic light emitting display increases, and the data driver which drives the organic light emitting display includes more integrated circuits. To solve the problems, a demux which includes fewer output lines of the data driver is used. The demux includes a plurality of data supplying switching transistors which are connected in common to the output line of the data driver, and the respective data supplying switching transistors are coupled to a data line. Therefore, the demux supplies each data line with a data signal in sequence through the operation of the data supplying switching transistors.

Here, RGB means red (Red, R), green (Green, G) and blue (Blue, B). In FIG. 11, three pixel circuits are coupled to the demux 1000, however, the number of pixel circuits is not limited. In addition, a data signal can be applied to pixel circuits by using a plurality of demuxes, the number of demuxes used is not limited.

In the demux 1000, each red data line, green data line and blue data line is coupled to the data line (D[M]) of the respective pixel circuits. In addition, each RGB data line is coupled to a RGB switching transistor (SW_TR3). The RGB switching transistor can consist of a red data line switching transistor (SW_TR3R), a green data line switching transistor (SW_TR3G) and a blue data line switching transistor (SW_TR3G). RGB control signals can be applied to a control electrode of the RGB switching transistors through RGB control line (CR, CG and CB) respectively.

Once the RGB switching transistor is turned on by the RGB control signals (CR, CG and CB), a proper data signal (voltage) can be applied to each RGB pixel circuits from the data driver through the demux.

The RGB switching transistors can be a P type channel transistor, but the kind of the switching transistor is not limited to this exemplary embodiment.

Figure 12:
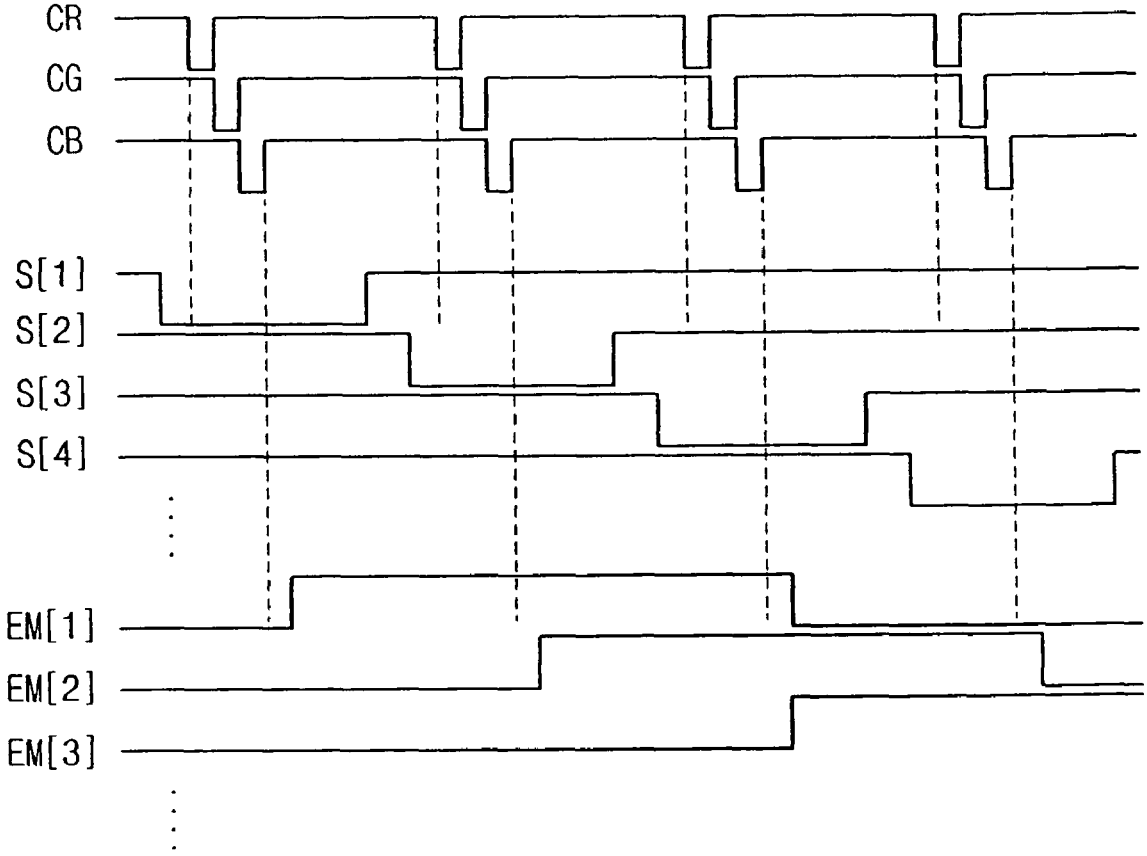
FIG. 12 is a driving timing diagram according to an embodiment of the RGB circuits.
Figure 13:
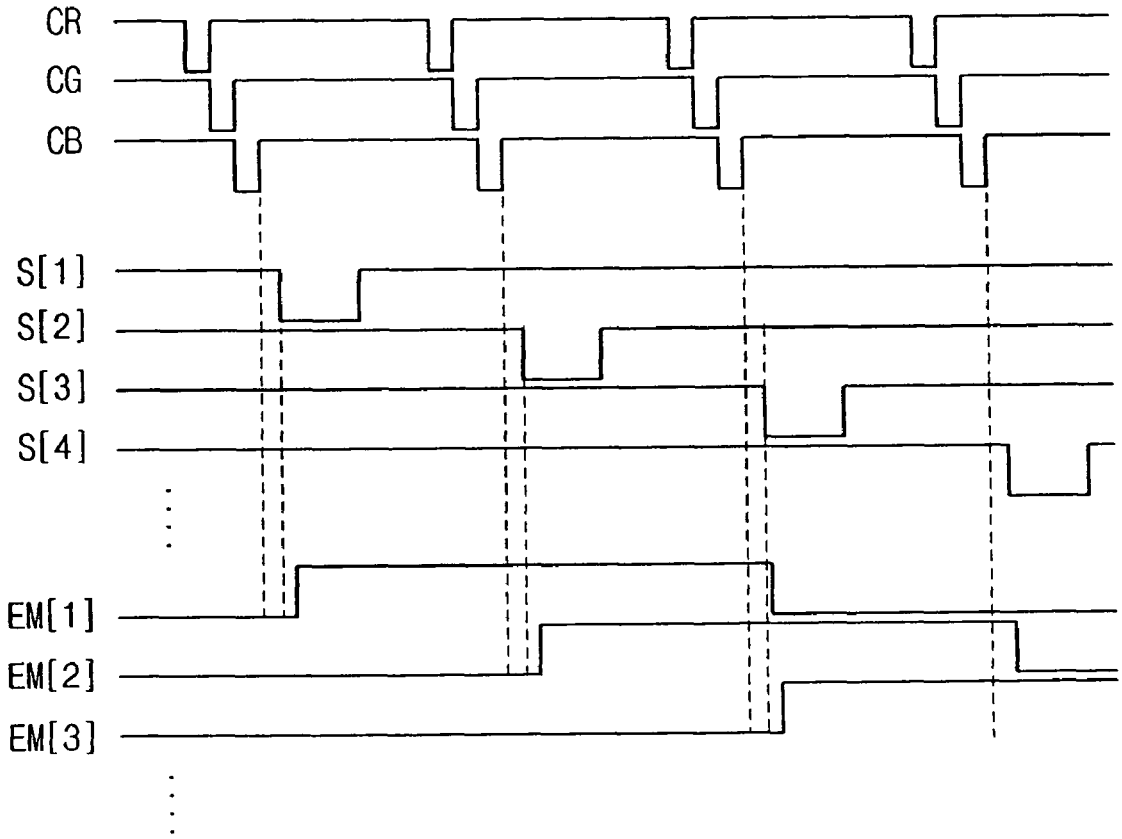
FIG. 13 is a driving timing diagram according to an alternate embodiment of the RGB circuits.

Referring to FIG. 12 and FIG. 13, driving timing diagrams of the RGB pixel circuits shown in FIG. 11 according to one embodiment and an alternate embodiment are depicted.

First of all, the operation of the RGB pixel circuits shown in FIG. 11 will be described with reference to the driving timing diagram of FIG. 12.

Once a scan signal of low level is applied through the scan line (S[N]), each first switching transistor (SW_TR1) of the RGB pixel circuits is turned on. And, once an emission control signal of low level is applied through the emission control line (EM[N]), each second switching transistor (SW_TR2) of the RGB pixel circuits can be turned on.

As described above, in a driving method for the organic light emitting display according to one embodiment of the present invention as shown in FIG. 12, the RGB switching transistors (SW_TR3) are turned on by applying a signal of low level through the RGB control lines (CR, CG and CB) during a period which the scan signal and the emission control signal are low level. Consequently, the RGB data signal can be applied during the period mentioned right above.

In case that a P type channel transistor is used as shown in FIG. 11, the RGB switching transistors (SW_TR3) are turned on when a signal of low level is applied to them. However, in case that an N type channel transistor is used, the RGB switching transistors (SW_TR3) are turned on as a signal of high level is applied to them. Consequently, the driving timing diagrams can be different. However, the present invention is not limited by the kind of the transistor and the driving timing diagram.

In the following, the operation of the RGB pixel circuits shown in FIG. 11 will be described with reference to the driving timing diagram of FIG. 13.

As a signal of high level is applied through the scan line (S[N]), each first switching transistor (SW_TR1) of the RGB pixel circuits is turned off. And, as a signal of low level is applied through the scan line (S[N]), each second switching transistor (SW_TR2) of the RGB pixel circuits is turned on.

As described above, in a driving method for the organic light emitting display according to an alternate embodiment as shown in FIG. 13, the RGB switching transistors (SW_TR3) are turned on by applying a signal of low level through the RGB control lines (CR, CG and CB) during the period which the scan signal is high level and the emission control signal is low level. Consequently, the RGB data signal can be applied during the period mentioned right above.

In case that a scan signal of high level is applied to the control electrode of the first switching transistor (SW_TR1) of the pixel circuit, of course, the first switching transistor (SW_TR1) is turned off. Consequently, during the period which a turn-off scan signal is applied, the RGB data signal should not be applied to the storage capacitor of the pixel circuit immediately. Rather, once the first switching transistor (SW_TR1) is turned on as a turn-on scan signal is applied to the control electrode of the first switching transistor (SW_TR1) of the pixel circuit after the data signal(voltage) is charged by a parasitic capacitor (Cd) formed at the data lines (D[M]), the data signals charged by the parasitic capacitor (Cd) formed at the data line (D[M]) can be applied through the first switching transistor (SW_TR1). The capacitance of the parasitic capacitor (Cd) can be larger than that of the first storage capacitor (C1) and the second storage capacitor (C2) included in the pixel circuit.

In case that a P type channel transistor is used as shown in FIG. 11, the RGB switching transistors (SW_TR3) are turned on when a signal of low level is applied to them. However, in case that an N type channel transistor is used, the RGB switching transistors (SW_TR3) are turned on as a signal of high level is applied to them. Consequently, the driving timing diagrams can be different. However, the invention is not limited by the kind of the transistor and the driving timing diagram.

As describe above, the RGB switching transistors (SW_TR3) are turned on by applying a signal of low level through the RGB control lines (CR, CG and CB) during the period which a signal of low level is applied from the emission control line (EM[N]), no matter which a signal of high level or a signal of low level is applied from the scan line (S[N]). Consequently, the storage capacitors which store a previous data voltage can be initialized as they are coupled to the first power supply line (VDD). Furthermore, the storage capacitors can be coupled to the first power supply line (VDD) as the second switching transistors (SW_TR2) of the pixel circuits are turned on by a signal of low level applied from the emission control line (EM[N]). As described above, proper data can be written on the storage capacitors by applying new RGB data signals after the storage capacitors are initialized.

Figure 14:
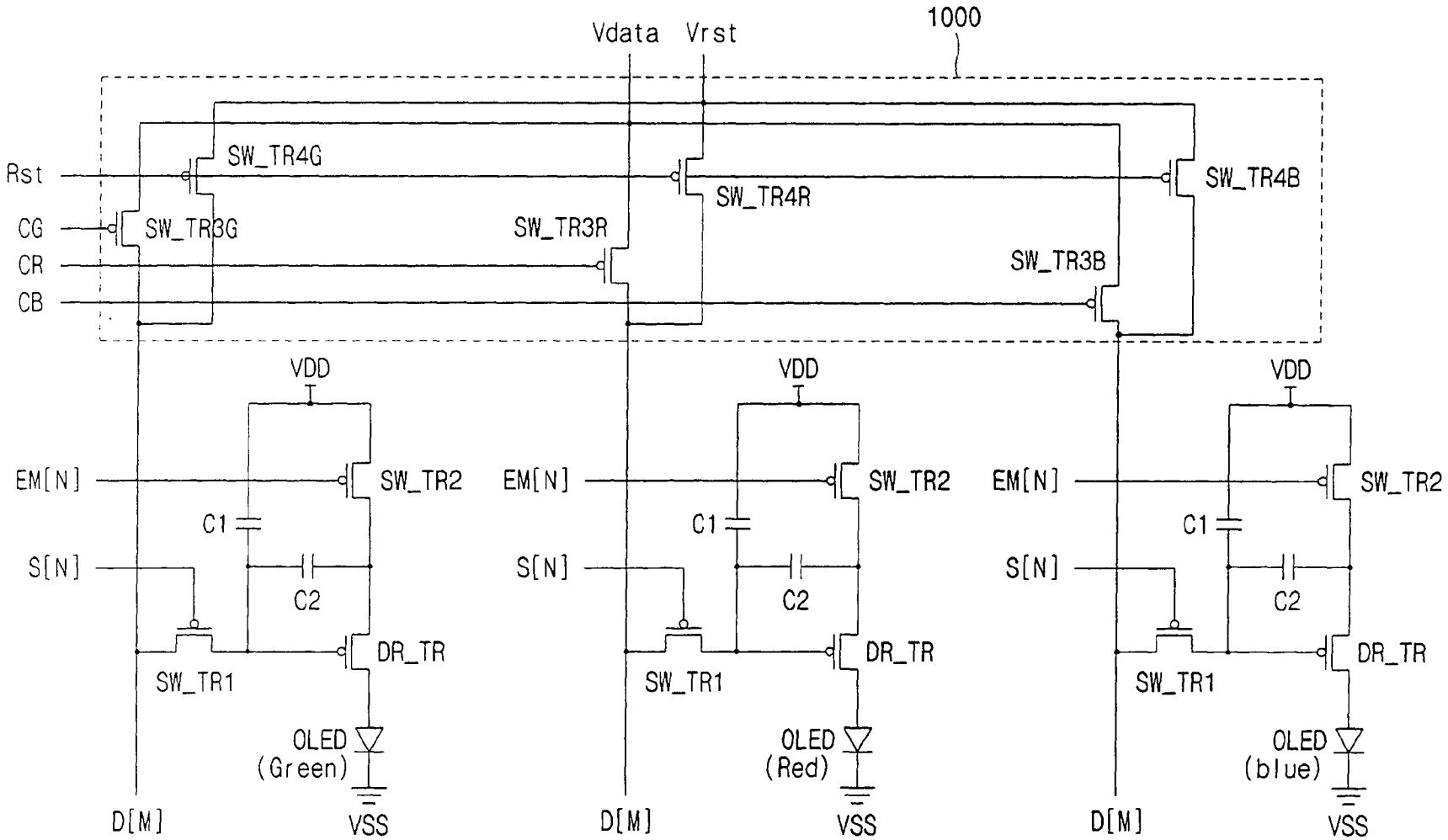
FIG. 14 is a drawing depicting how RGB pixel circuits and a demux are coupled according to an alternate embodiment.

Referring to FIG. 14, it is depicted how the RGB pixel circuits and the demux are coupled according to an alternate embodiment.

The demux 1000 is a demux which has a layout structure which corresponds to each RGB data signal of the data driver of the organic light emitting display, and it is similar to the demux shown in FIG. 11. However, the demux 1000 also includes an initializing power supply voltage line (Vrst) and an initializing switching transistor (SW_TR4) which couples the initialing power supply voltage line (Vrst) to a RGB data voltage line.

Three pixel circuits are coupled to the demux 1000 in FIG. 14, however, the number of pixel circuits coupled to the demux is not limited. In addition, a data signal can be applied to the pixel circuits by using a plurality of DeMuxes, and the number of DeMuxes used is not limited.

In the demux 1000 shown in FIG. 14, each red data line, green data line and blue data line is coupled to the data line (D[M]) of the respective pixel circuits. In addition, each RGB data line is coupled to RGB switching transistor (SW_TR3). The RGB switching transistor can consist of a red data line switching transistor (SW_TR3R), a green data line switching transistor (SW_TR3G) and a blue data line switching transistor (SW_TR3G). RGB control signals can be applied to a control electrode of the RGB switching transistors through RGB control lines (CR, CG and CB) respectively.

Once the RGB switching transistor is turned on by the respective RGB control signals (CR, CG and CB), a proper data signal (voltage) from the data driver can be applied to each RGB pixel circuit through the demux.

In addition, the initializing power supply voltage line (Vrst) is coupled to the respective RGB data line through the initializing switching transistor (SW_TR4). Once a turn-on initializing signal (Rst) is applied to the initializing switching transistor (SW_TR4), the initializing switching transistors (SW_TR4G, SW_TR4R and SW_TR4B) are turned on, then an initializing power supply voltage can be applied to the respective RGB data line from the initializing power supply voltage line (Vrst). As the initializing power supply voltage is applied, the previous data voltages applied to the RGB data lines are initialized. Consequently, new RGB data signals (voltages) can be applied.

The RGB switching transistor and the initializing power supply voltage can be a P type channel transistor, however, the kind of the transistor is not limited.

A thin film transistor can be used as the RGB switching transistor (SW_TR3) shown in FIG. 11 and the initializing switching transistor (SW_TR4) shown in FIG. 14. Furthermore, as a crystallization method for the thin film transistor, a laser crystallization method (ELA) using an excimer laser, a metal induced crystallization (MIC) using a catalytic metal and a solid phase crystallization can be used. In addition, a high pressure annealing (HPA) wherein crystallization is executed at a high temperature and a high humidity environment and a sequential lateral solidification using a mask in addition to conventional laser crystallization can be used as well.

The laser crystallization method, in which a thin film transistor is crystallized into poly silicon may be used. Not only can the method directly use existing crystallization processes for poly silicon liquid crystal display devices, but also the process is simple, and the technology of the process has been completely established.

The metal induced crystallization method is one of the methods by which the crystallization can be accomplished at a low temperature without using the laser crystallization method. Initially, catalytic metals such as Ni, Co, Pd, and Ti are deposited or spin-coated on the surface of amorphous silicon, then the catalytic metals penetrate directly into the surface of the amorphous silicon. Consequently, it has a merit in that the amorphous silicon can be crystallized at a low temperature while changing the phase of the amorphous silicon. A modification of the metal induced crystallization method has a merit in that when a metal layer is interposed on the surface of the amorphous silicon, the intervention of contaminants such as Nickel silicide in specific regions of the thin film transistor can be suppressed maximally using a mask. The crystallization method mentioned above is also called a metal induced lateral crystallization (MILC). A shadow mask can be used in the metal induced lateral crystallization, and the shadow mask can be a linear mask or a dot shaped mask.

Another modification of the metal induced crystallization method is a metal induced crystallization with capping layer (MICC), wherein when a catalytic metal layer is deposited or spin-coated on the surface of amorphous silicon, a capping layer is interposed first so that the amount of the catalytic metal flowing into the amorphous silicon can be controlled. A silicon nitride film can be used for the capping layer. The amount of the catalytic metal flowing from the catalytic metal layer into the amorphous silicon can change according to the thickness of the nitride layer. Here, the catalytic metal flowing into the silicon nitride film can be formed on the entire surface of the silicon nitride film, and it can also be formed selectively by using a shadow mask and the like. The capping layer can be removed selectively after the catalytic metal layer crystallizes the amorphous silicon into poly silicon. To remove the capping layer, a method of wet etching or dry etching can be used. Furthermore, after the poly silicon is formed, a gate insulating layer is formed, and then a gate electrode is formed on the gate insulating layer. An inter-layer dielectric layer can be formed on the gate electrode. After a via hole is formed on the inter-layer dielectric layer, impurities are introduced into the crystallized poly silicon phase through the via hole to further eliminate catalytic metal impurities dispersed in the poly silicon phase. This method of further eliminating catalytic metal impurities is referred to as a gettering process. The gettering process includes, in addition to a process of introducing the impurities, a heating process of heating thin film transistor. A high quality thin film transistor can be obtained through the gettering process.

Figure 15:
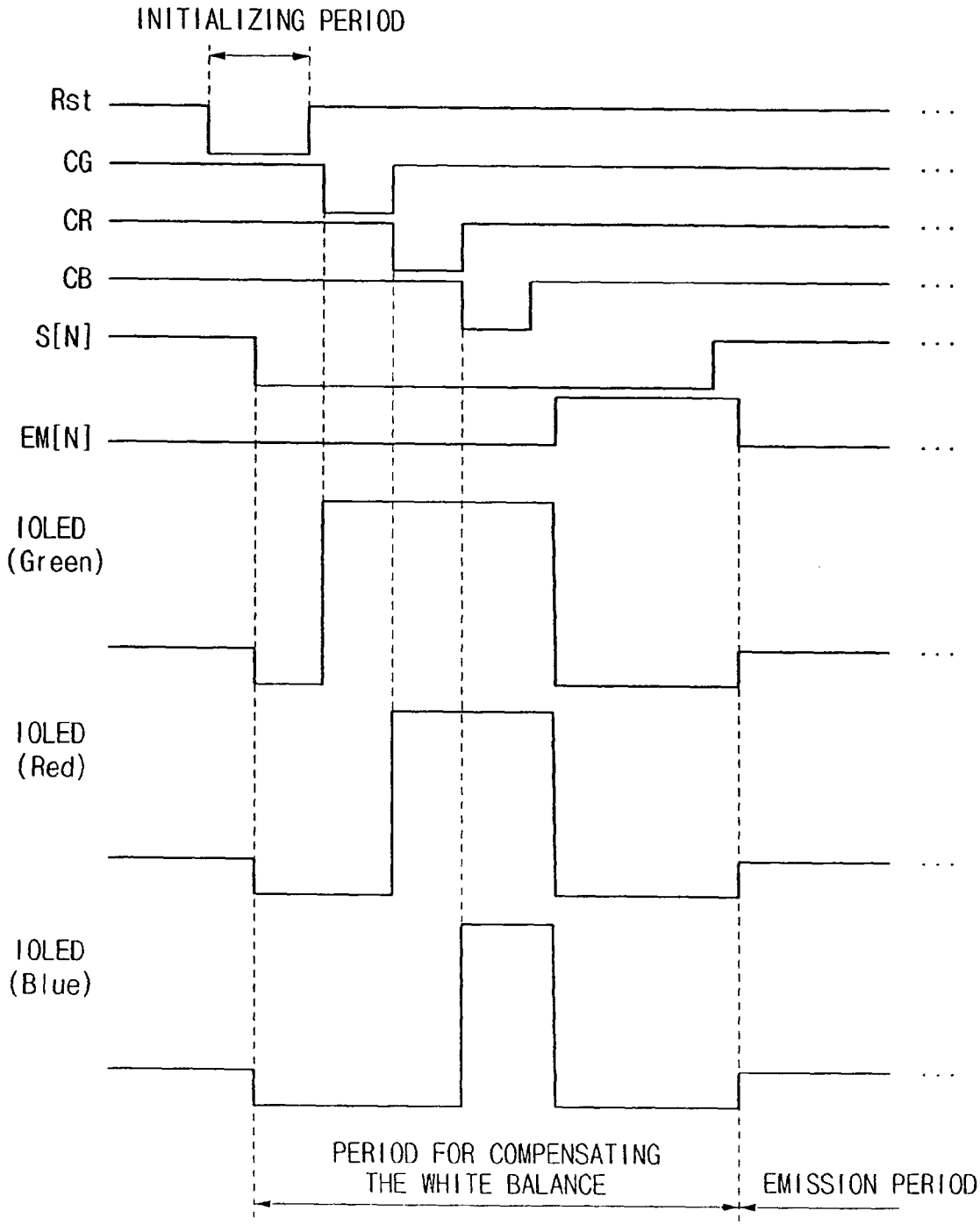
FIG. 15 is a driving timing diagram of the RGB pixel circuits.

Referring to FIG. 15, a driving timing diagram of the RGB pixel circuits shown in FIG. 14 is depicted.

Hereinafter, the operation of the RGB pixel circuits shown in FIG. 14 will be described with reference to the driving timing diagram of FIG. 15.

Once an initializing signal of low level is applied through an initializing signal line (Rst), the initializing switching transistors (SW_TR4) in the demux are turned on, consequently, data lines can be initialized by the initializing power supply voltage from the initializing power supply voltage line (Vrst).

Once an emission control signal of low level is applied through the emission control line (EM[N]), and a scan signal of low level is applied from the scan line (S[N]), then the RGB switching transistors (SW_TR3R, SW_TR3G and SW_TR3B) can be turned on as a signal of low level is applied through the RGB control signal line during the period mentioned above.

The RGB control signal is applied in order of a green, red and blue control signal. Consequently, the RGB data voltage is applied to the respective green, red and blue pixel circuits in sequence.

As shown in FIG. 15, a green organic light emitting diode (OLED Green) emits light as a current flows through the green organic light emitting diode (OLED Green) from the period during which a green emission control signal is applied to the period during which an emission control signal of high level from the emission control line (EM[N]) is applied.

A red organic light emitting diode (OLED Red) emits light as a current flows through the red organic light emitting diode (OLED Red) from the period during which a red emission control signal is applied to the period during which an emission control signal of high level from the emission control line (EM[N]) is applied.

In addition, a blue organic light emitting diode (OLED Blue) emits light as a current flows through the blue organic light emitting diode (OLED Blue) from the period during which a blue emission control signal is applied to the period during which an emission control signal of high level from the emission control line (EM[N]) is applied.

As shown in FIG. 15, during the period for compensating the white balance, a current flows through a green organic light emitting diode for the longest time, and a red green organic light emitting diode is next, and a blue organic light emitting diode is the last.

As described above, the reason why the time for compensating the white balance is arranged in order of green, red and blue is that a green signal has a higher luminous efficiency than a red and green signal. That is to say, in order to adjust the white balance, a current should flow through a green organic light emitting diode of the best luminous efficiency for the longest time during the non-emission period (the period for compensating the white balance). Next, in order of a red and blue, the period for compensating the white balance is executed, thereby a uniform luminance can be accomplished. During the period for compensating the white balance, a larger current flows through the organic light emitting diode than a current flowing during the emission period.

During displaying one frame, the period for compensating the white balance can be shorter than the emission period.

As described above, in the organic light emitting display when an RGB data signal is applied by using a demux, the RGB data can be stored in the respective storage capacitor of pixel circuits properly by applying the RGB data signal during a period which an emission control signal is turned on regardless of either a scan signal turned on or off.

That is to say, a new RGB data signal can be stored in the storage capacitors properly as the respective storage capacitors are initialized by the first power supply voltage of the first power supply line before RGB data is applied to each storage capacitor of the pixel circuits.

In addition, the pixel circuit of the organic light emitting display can classify a period for displaying one frame into the first period (T1), the second period (T2) and the third period (T3). Each period consists of a data writing period (T1), a period for storing the threshold voltage of the driving transistor (T2) and an emission period (T3).

In the organic light emitting display, high integration can be accomplished by using three transistors which is fewer number than the number of the transistors of a conventional pixel circuit. Consequently, high resolution also becomes possible.

The uniformity of the luminance can be improved by compensating the threshold voltage (Vth), controlling the ratio (C1:C2) of a first storage capacitor to a second storage capacitor properly. Furthermore, bad effects of IR-drop by a first power supply line (VDD) can be improved by controlling the capacitance ratio of the first storage capacitor to the second storage capacitor.

In the pixel circuit, an improper emission of the organic light emitting diode can be suppressed because an electric connection through which a leakage current can flow from the control electrode of the driving transistor to the negative power supply voltage does not exist.

Furthermore, in the case of the driving method according to another embodiment wherein RGB data signal is applied by using the demux, during the non-emission period (the period for compensating the white balance), a current may flow through a green organic light emitting diode of the best luminous efficiency for the longest time. Next, in order of a red and blue organic light emitting diode, the period for compensating the white balance is executed. Consequently, a uniform luminance level can be accomplished.

That is to say, the problem, in that the color wanted cannot be reproduced because the white balance is changed as time goes by, can be solved because the period for compensating the white balance is executed during the emission period.

The detailed description mentioned above addresses example embodiments, and the present invention is not limited to the embodiments described above. In addition, the spirit of the present invention includes various modifications and changes which can be made.

What is claimed is:

1. An organic light emitting display, comprising:

a demux coupled to data lines, the demux configured to receive a data voltage at an input and to apply the data voltage through an output to the data lines; and a plurality of pixel circuits coupled to the data lines, wherein the data voltage is supplied to each pixel circuit according to a scan signal, wherein the scan signal and a turn-on emission control signal are simultaneously supplied to each of the pixel circuits, and wherein the pixel circuits are each coupled to a scan line and a data line, the pixel circuits each comprising:

a first switching transistor comprising a control electrode coupled to the scan line, a first electrode coupled to the data line;

a driving transistor coupled between a first power supply line and a second power supply line, the driving transistor comprising a control electrode coupled to the first switching transistor;

a first storage capacitor coupled to the first power supply line and directly connected to the first switching transistor and the driving transistor;

a second switching transistor coupled to the first power supply line and the driving transistor, and comprising a control electrode coupled to an emission control line;

a second storage capacitor coupled to the second switching transistor and directly connected to the first switching transistor, the first storage capacitor, and the driving transistor; and an organic light emitting diode coupled to the driving transistor and the second power supply line.

2. The organic light emitting display as claimed in claim 1, wherein the pixel circuits are coupled to a common scan line and a common emission control line.

3. The organic light emitting display as claimed in claim 1, wherein the pixel circuits are coupled to a common first power supply line and a common second power supply line.

4. The organic light emitting display as claimed in claim 1, wherein the pixel circuits are configured to receive a turn-on scan signal during a period which the data voltage of the demux is applied.

5. The organic light emitting display as claimed in claim 1, wherein the pixel circuits are configured to receive a turn-off scan signal during a period which the data voltage of the demux is applied.

6. The organic light emitting display as claimed in claim 1, wherein the pixel circuits are coupled to a scan line and a data line, the pixel circuits each comprising:

a first switching transistor comprising a control electrode coupled to the scan line, a first electrode coupled to the data line;

a driving transistor coupled between a first power supply line and a second power supply line, the driving transistor comprising a control electrode coupled to the first switching transistor;

a first storage capacitor coupled to the first switching transistor, the first power supply line and the driving transistor;

a second switching transistor coupled to the first power supply line and the driving transistor, and comprising a control electrode coupled to an emission control line;

a second storage capacitor coupled to the first switching transistor, the first storage capacitor, the second switching transistor and the driving transistor; and an organic light emitting diode coupled to the driving transistor and the second power supply line.

7. The organic light emitting display as claimed in claim 6, wherein the first switching transistor includes a control electrode coupled to the scan line, a first electrode coupled to the data line, and a second electrode coupled to a control electrode of the driving transistor.

8. The organic light emitting display as claimed in claim 6, wherein the first switching transistor applies data from the first electrode to the second electrode in response to a signal at the control electrode of the first switching transistor from the scan line.

9. The organic light emitting display as claimed in claim 6, wherein the driving transistor includes a control electrode coupled to the second electrode of the first switching transistor, a first electrode coupled to a second electrode of the second switching transistor, and a second electrode coupled to an anode of the organic light emitting diode.

10. The organic light emitting display as claimed in claim 6, wherein the driving transistor controls a driving current from the first power supply line when the control electrode of the driving transistor is coupled to the second electrode of the first switching transistor.

11. The organic light emitting display as claimed in claim 6, wherein the first storage capacitor includes a first electrode coupled to the first power supply line, and a second electrode coupled to the second electrode of the first switching transistor and the control electrode of the driving transistor.

12. The organic light emitting display as claimed in claim 6, wherein the first storage capacitor includes a first electrode coupled to the first power supply line and a second electrode coupled to a second electrode of the second storage capacitor.

13. The organic light emitting display as claimed in claim 6, wherein the second switching transistor includes a control electrode coupled to the emission control line, a first electrode coupled to the first power supply line, and a second electrode coupled to the first electrode of the driving transistor.

14. The organic light emitting display as claimed in claim 6, wherein the second switching transistor includes a control electrode coupled to the emission control line, a first electrode coupled to the first power supply line, and a second electrode coupled to a first electrode of the second storage capacitor.

15. The organic light emitting display as claimed in claim 6, wherein the second storage capacitor includes a first electrode coupled to the second electrode of the second switching transistor and the first electrode of the driving transistor, and a second electrode coupled to the second electrode of the first storage capacitor, the second electrode of the first switching transistor and the first electrode of the driving transistor.

16. The organic light emitting display as claimed in claim 6, wherein the second storage capacitor is coupled to the control electrode of the driving transistor and the first electrode of the driving transistor.

17. The organic light emitting display as claimed in claim 6, wherein the organic light emitting diode includes an anode coupled to the second electrode of the driving transistor and a cathode coupled to the second power supply line.

18. The organic light emitting display as claimed in claim 6, wherein the first switching transistor, the second switching transistor and the driving transistor are N type channel transistors.

19. The organic light emitting display as claimed in claim 6, wherein the first switching transistor, the second switching transistor and the driving transistor are P type channel transistors.

20. The organic light emitting display as claimed in claim 6, wherein the organic light emitting diode includes an emission layer, and the emission layer comprises at least one of a fluorescent material, a phosphorescence material, and a mixture of the fluorescent material and the phosphorescence material.

21. The organic light emitting display as claimed in claim 6, wherein the emission layer comprises at least one of the following: a red, a green, and a blue light emitting material.

22. The organic light emitting display as claimed in claim 6, wherein the driving transistor comprises at least one of the following: an amorphous silicon thin film transistor, a poly silicon thin film transistor, an organic thin film transistor, and a nano thin film transistor.

23. The organic light emitting display as claimed in claim 6, wherein the driving transistor comprises a poly silicon transistor including any of Ni, Cd, Co, Ti, Pd, and W.

24. The organic light emitting display as claimed in claim 6, wherein a second power supply voltage of the second power supply line is lower than a first power supply voltage of the first power supply line.

25. The organic light emitting display as claimed in claim 6, wherein the second power supply voltage of the second power supply line is a ground voltage.

26. The organic light emitting display as claimed in claim 6, configured such that while displaying a frame, once the first switching transistor and the second switching transistor are turned on, a data voltage from the data line is applied to the second electrode of the first storage capacitor, the second electrode of the second storage capacitor and the control electrode of the driving transistor, and the first power supply voltage from the first power supply line is applied to the first electrode of the first storage capacitor and the first electrode of the second storage capacitor.

27. The organic light emitting display as claimed in claim 6, configured such that while displaying a frame, after the first switching transistor is turned on and the second switching transistor is turned off, a data voltage from the data line is applied to the second electrode of the first storage capacitor, the second electrode of the second storage capacitor and the control electrode of the driving transistor, and the first power supply voltage from the first power supply line is applied to the first electrode of the first storage capacitor.

28. The organic light emitting display as claimed in claim 6, configured such that while displaying a frame, after the first switching transistor is turned off and the second switching transistor is turned on, the first power supply line, the driving transistor, and the organic light emitting diode are electrically coupled to one another, wherein a current is applied in a direction from the anode of the organic light emitting diode to the cathode of the organic light emitting diode.

29. The organic light emitting display as claimed in claim 6, further comprising an emission control switching transistor coupled to the driving transistor and the organic light emitting diode.

30. The organic light emitting display as claimed in claim 29, wherein the emission control switching transistor includes a control electrode coupled to the emission control line, a first electrode coupled to the second electrode of the driving transistor, and a second electrode coupled to the anode of the organic light emitting diode.

31. The organic light emitting display as claimed in claim 29, wherein the emission control switching transistor is an N type channel transistor.

32. The organic light emitting display as claimed in claim 29, the emission control switching transistor is a P type channel transistor.

* * * * *